US011015776B2

(12) United States Patent
Gomez Martinez et al.

(10) Patent No.: US 11,015,776 B2
(45) Date of Patent: May 25, 2021

(54) ARCHITECTURAL LINEAR LUMINAIRE

(71) Applicant: NICOR, INC., Albuquerque, NM (US)

(72) Inventors: Jorge Alfredo Gomez Martinez, Albuquerque, NM (US); David Brown, Rio Rancho, NM (US); Ye Jin, Albuquerque, NM (US); Jiabin Yu, Zhongshan (CN); Zihai Lu, Zhongshan (CN); Trevor Shaw, Albuquerque, NM (US)

(73) Assignee: NICOR, INC., Albuquerque, NM (US)

( * ) Notice: Subject to any disclaimer, the term of this patent is extended or adjusted under 35 U.S.C. 154(b) by 112 days.

(21) Appl. No.: 16/405,876

(22) Filed: May 7, 2019

(65) Prior Publication Data

US 2019/0264882 A1 Aug. 29, 2019

Related U.S. Application Data

(63) Continuation-in-part of application No. 16/169,856, filed on Oct. 24, 2018, now Pat. No. 10,824,427.

(60) Provisional application No. 62/576,877, filed on Oct. 25, 2017, provisional application No. 62/668,642, filed on May 8, 2018, provisional application No.
(Continued)

(51) Int. Cl.

| | |
|---|---|
| ***F21V 19/00*** | (2006.01) |
| ***F21S 8/04*** | (2006.01) |
| ***F21V 15/015*** | (2006.01) |
| ***F21V 23/00*** | (2015.01) |
| ***F21K 9/20*** | (2016.01) |

(Continued)

(52) U.S. Cl.
CPC ..... *F21S 8/043* (2013.01); *F21K 9/20* (2016.08); *F21V 15/015* (2013.01); *F21V 23/006* (2013.01); *F21Y 2103/10* (2016.08); *F21Y 2115/10* (2016.08)

(58) Field of Classification Search
CPC ... F21V 15/013; F21V 23/002; F21V 19/0045
See application file for complete search history.

(56) References Cited

U.S. PATENT DOCUMENTS

2007/0047229 A1* 3/2007 Lee ..... F21V 15/013 362/237
2007/0058377 A1* 3/2007 Zampini, II ..... F21V 15/013 362/372

(Continued)

*Primary Examiner* — Andrew J Coughlin
(74) *Attorney, Agent, or Firm* — Loza & Loza LLP; Richard H. Krukar

(57) ABSTRACT

Luminaire housings for architectural, industrial and warehouse applications have extrusions with parallel flat sides connected by a cross member. The wireway can be enclosed by the extrusion's roof or by cover segments clamped over an open top extrusion. Wireway openings provide access to the wireway. Nuts slid into T-channels in the roof or cover segments provide for mounting or suspension via wall brackets, cables, and housing brackets. Threaded nipples accessible through the roof or cover segments provide for pendant stem mounting. Continuous run brackets can join housings end to end. Optical elements slid into slots and channels in the housing can be retained by end caps. A housing cover over the wireway can be clamped in place by screws threaded into fixture brackets retained within the housing. The housing grooves in the cover segments can slidably engage the extrusion until the cover segments are clamped in place.

19 Claims, 26 Drawing Sheets

Related U.S. Application Data

62/764,678, filed on Aug. 15, 2018, provisional application No. 62/668,677, filed on May 8, 2018.

(51) Int. Cl.
*F21Y 103/10* (2016.01)
*F21Y 115/10* (2016.01)

(56) References Cited

U.S. PATENT DOCUMENTS

2012/0162982 A1* 6/2012 Wang ..... F21V 13/12
362/235
2013/0094225 A1* 4/2013 Leichner ..... F21S 4/28
362/368
2016/0076743 A1* 3/2016 Deutsch ..... F21V 7/0091
362/268

* cited by examiner

ARCHITECTURAL LINEAR LUMINAIRE

CROSS REFERENCE TO RELATED APPLICATIONS

This patent application is a continuation in part of U.S. patent application Ser. No. 16/169,856 and claims the priority and benefit of U.S. Provisional Patent Applications 62/576,877, 62/668,642, 62/764,678, and 62/668,677. U.S. patent application Ser. No. 16/169,856 is titled "METHOD AND SYSTEM FOR POWER SUPPLY CONTROL" and was filed Oct. 24, 2018. U.S. Provisional Patent Application 62/576,877 is titled "LUMINAIRE POWER BANK" and was filed Oct. 25, 2017. U.S. Provisional Patent Application 62/668,642 is titled "METHOD AND SYSTEM FOR POWER SUPPLY CONTROL" and was filed May 8, 2018. U.S. Provisional Patent Application 62/764,678 is titled "METHOD AND SYSTEM FOR POWER SUPPLY CONTROL" and was filed Aug. 15, 2018. U.S. Provisional Application 62/668,677 is titled, "ARCHITECTURAL LINEAR LUMINAIRE" and was filed on May 8, 2018. U.S. patent application Ser. No. 16/169,856 and U.S. Provisional Patent Applications 62/576,877, 62/668,642, 62/764,678, and 62/668,677 are herein incorporated by reference in their entirety.

TECHNICAL FIELD

Embodiments are generally related to LED lighting, lighting fixtures, and LED lighting power supplies.

BACKGROUND

Lighting systems have been evolving at a rapid pace with moves from incandescent, fluorescent, and gas discharge to light emitting diodes (LEDs). LEDs have been improving in efficiency, thermal management, and cost. Similarly, the power supplies, a.k.a. drivers, which drive the LEDs have seen improvements in efficiency, thermal management and cost. In general, residential and commercial lighting is transitioning to the use of LED lighting technologies.

U.S. Pat. No. 7,311,423 by Frecska et al. issued on Dec. 25, 2007 and is titled "Adjustable LED Luminaire." Frecska teaches a luminaire having multiple movable LED strips in a large fixture. It is for its teachings of LED arrays, electronics, drivers, and fixtures that U.S. Pat. No. 7,311,423 is herein incorporated by reference in its entirety.

U.S. Pat. No. 7,476,004 by Chan issued on Jan. 13, 2009 and is titled "LED Lighting Lamp Tube." Chan teaches LED arrays mounted in tubes and configured to replace fluorescent light tubes in fluorescent fixtures. Replacements such as Chan's have provided an early upgrade path for commercial lighting in the move from fluorescent to LED. It is for its teachings of LED arrays, electronics, drivers, and fixtures that U.S. Pat. No. 7,476,004 is herein incorporated by reference in its entirety.

U.S. patent application Ser. No. 13/383,917 by Burrow et al. published as US 20120113628 on May 10, 2012 and is titled "Light Emitting Diode Retrofit Conversion Kit for a Fluorescent Light Fixture." Burrow also teaches LED arrays configured to replace fluorescent light tubes in fluorescent fixtures. Replacements such as Burrow's have provided an early upgrade path for commercial lighting in the move from fluorescent to LED. It is for its teaching s of LED arrays, electronics, drivers, and fixtures that US 20120113628 is herein incorporated by reference in its entirety.

U.S. patent application Ser. No. 13/075,494 by Handsaker published as US 20120250309 on Oct. 4, 2012 and is titled "LED Lighting Fixture With Reconfigurable Light Distribution Pattern." Handsaker teaches modular LED arrays with reconfigurable lenses and a fixture with an extruded aluminum base. It is for its teachings of LED arrays, electronics, drivers, and fixtures that US 20120250309 is herein incorporated by reference in its entirety.

U.S. patent application Ser. No. 13/473,929 by Araki, et al. published as US 20120320627 on Dec. 20, 2012 and is titled "Flat Panel Lighting Device and Driving Circuitry." Araki teaches modular LED arrays and drivers configured in a relatively thin flat frame that can be edge lit. It is for its teachings of LED arrays, electronics, drivers, and fixtures that US 20120320627 is herein incorporated by reference in its entirety.

U.S. patent application Ser. No. 14/210,991 by Ishii published as US 20150016100 on Jan. 15, 2015 and is titled "Luminaire." Ishii teaches a fixture having an LED array and drivers with a long lens covering the electronic components. It is for its teachings of LED arrays, electronics, drivers, and fixtures that US 20150016100 is herein incorporated by reference in its entirety.

As can be inferred by this background section, the prior art discloses luminaires that can be used commercially, but that the overall packaging, fixtures, drivers, interconnects, and designs are still evolving. Systems and methods that provide commercial LED lighting with advanced packaging, fixtures, drivers, interconnects, and designs are needed.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is an aspect of the embodiments that a luminaire has a housing formed from an extrusion and two end caps. The extrusion can be formed from aluminum. Extrusion is a process of shaping material by forcing it to flow through a shaped opening in a die. The extruded material, often called an extrusion, emerges as an elongated piece having a profile that is substantially identical to the profile of the die opening. The profile has width and height dimensions. The extrusion can be cut to a length, thereby determining the housing's length. The end caps are attached to the ends of the extrusion.

The profile has features defining the extrusion's length running elements. As such, the length running elements are generally parallel to one another and run the complete length of the extrusion. The length running elements can include a roof, two side walls, a cross member, a plurality of screw grooves, at least one distinct rib array, three T-channels, an LED array facing, two lens slots, two LED alignment ribs, and two reflector slots. When viewing the extrusion's profile, the roof and the side walls form three sides of a rectangle while the cross member connects the side walls to form a wireway between the roof and cross member. A bottom cavity is underneath the cross member. The T-channels are formed in the roof with one, the center T-channel, centered on the roof and the others symmetrically located on either side of the center T-channel. The T-channels all have the same profile and are designed such that a bolt or nut can be slid into the T-channel and used to secure items to the roof. The end caps close the wireway and have T-cutouts, sized and positioned to act as continuations of the T-channels, allowing bolts, nuts, and other elements to be slid into the T-channels of assembled housings.

It is another aspect of the embodiments that housings can be joined end-to-end by continuous run brackets. The continuous run brackets have T-rails that can slide through the T-cutouts and into the T-channels. The continuous run brackets can be screwed to the roofs of the housings to firmly join them. The joined housings have end caps that are face to face at the joint. Those end caps can have inter-housing knockouts. An inter-housing knockout, when knocked out, allows wiring to pass from one housing's wireway, through the end cap, and into the other housing's wireway. In essence, an extended wireway is formed. Two joined housings can have two extrusions and four end caps. Typical embodiments have equal length extrusions.

It is a further aspect of the embodiments that light engines are installed in the housings. Each light engine has an LED array, a reflector, and a diffusing lens. The LED array has rows of LEDs attached to a circuit substrate. A power input, usually solder pads or a connector, on the circuit substrate can receive electric power and circuit traces on the circuit substrate can pass the electric power to the LEDs. The circuit substrate can be U-shaped with two long legs separated by a cut-out and bridged at one end. For example, each leg can have one row of LEDs or a double row of LEDs. The power input is typically positioned on the bridging element while the long legs are designed to extend the length of the housing. The LEDs are mounted on the legs. This design is advantageous in that more LED arrays can be produced from a given amount of substrate.

A light engine can be installed in a housing by attaching it to the LED array facing between the LED alignment ribs. The LED array, reflector, and diffusing lens extend from one end cap to the other. The diffusing lens can slide into the two lens slots at the bottom of the extrusion, thereby enclosing the bottom cavity. The reflector, typically formed from a white flexible material, is between the cross member and the diffusing lens and has openings for passing light from the LEDs to the lens. The reflector can slide into the extrusion's reflector slots. The reflector's size causes it to flex when installed and to form a concave reflecting surface. A thermal compound between the LED array and the cross member can facilitate the transfer of heat from the LEDs into the housing. The lens is typically a transparent, translucent, or frosted optical element that is slid into the lens channels and parallel to the LED array. Light from the LEDs can pass through the lens to thereby provide illumination.

A light engine can include a power conditioner. A lighting system can receive electric power that is already conditioned for use by the LEDs or can receive unconditioned power, typically mains power (e.g. 120 VAC, 220 VAC, . . . ). A power conditioner conditions the electric power for use by the LEDs. A housing can have a power block opening in its roof sized to accept the power conditioner. The power conditioner can be attached to a driver cover and the driver cover installed to cover the power block opening. In this manner, a power conditioner is installed in the wireway of a housing.

It is a still further aspect of the embodiments that a wireway cover can cover a wireway opening in the roof of a housing. Wireway covers can typically be easily removed and reinstalled to thereby cover and uncover a wireway opening. A wireway cover can simply cover the wireway opening and block access to the wireway. Alternatively, a wireway cover can have a knockout that can be pushed free of the wireway cover to produce a hole in the wireway cover. Wires can pass through the hole in the wireway cover and into the top opening and the wireway. A wireway cover can use an electrical connector for passing electric power or signals into the luminaire. An electric cable, such as an IMS cable, shielded cable or Ethernet cable can provide electric power and/or signals to the electrical connector, thereby powering and/or controlling the luminair.

The electrical connector can be a panel feedthrough terminal block. For example, electrical power can be provided to the luminaire by an electric cable having at least two distinct conductors. Here, distinct conductor means insulated from one another such as an insulated wire and a bare wire or two insulated wires. In practice, the electric cable would have a power line, a return line, and possibly a ground line. The power line and return line are typically insulated wires while the ground line can be either a bare wire or an insulated wire. A 18/2 shielded cable is an example of an electric cable. The terminal block can be attached to a wireway cover or endcap and can be configured to pass electrical power from external wiring and into the internal wiring and circuitry of the luminaire. An 18/2 shielded cable is a shielded cable with two 18 gauge insulated wires and an internal shield covered by an outside insulator. An 18/4 shielded cable can carry electric power and control signals. The cable's shield or an additional wire can provide a ground connection. Electricians and those knowledgeable of electric wiring or the installation of electrical components are familiar with shielded cables and terminal blocks such as panel feed through terminal blocks.

Using an RJ45 socket as the electrical connector provides for using Ethernet cables to supply the luminaire with electric power or signals. Power Over Ethernet (POE) is a known set of standards for supplying power and signals to computer network equipment via Ethernet cables. An RJ45 socket has a row of eight connectors. A luminaire can be powered via POE or can be powered by simply running power with no signals into two or more of those connectors. For example, the power line can connect to the leftmost four connectors while the return line can connect to the rightmost four connectors. In such embodiments, an RJ45 power circuit that includes the RJ45 socket can be fixedly attached to the wireway cover while a hole in the wireway cover provides access to the RJ45 socket. Embodiments can pass power through an endcap by, for example, fixedly attaching the RJ45 power circuit to an endcap while a hole in the endcap provides access to the RJ45 socket.

A wireway cover can be attached to the housing cover by one or more screws or other fasteners. A downward bend and tab arrangement can hold one end of the wireway cover in the wireway opening such that a single screw in the other end can fix the wireway cover in place.

It is yet another aspect of the embodiments that housings can have fixture brackets assemblies from which the housing can be suspended. The fixture bracket assemblies can include a fixture bracket, threaded nipple, and lock nut. The fixture bracket can be attached to the roof of the housing and inside the wireway. The threaded nipple, attached to the fixture bracket, can be accessed through a hole in the roof. Suspension cables attached to the fixture brackets or threaded nipples can hold the housing aloft. Pendant stems threaded onto the threaded nipples can hold the housing aloft. Wiring can be passed through the hollow pendant stems and threaded nipples and into the wireway.

It is a still yet further aspect of the embodiments that the housings can be mounted or suspended by housing brackets and ceiling brackets. The housing brackets can be attached to a housing directly over the wireway openings by screws threaded into the roof or using screws/nuts in a T-channel. Typically, the screws and nuts slid into the T-channels are too large to rotate within the T-channel. The ceiling brackets can be attached to a ceiling or to junction boxes. The ceiling brackets can be sized as junction box cover plates. The housing brackets can be removably attached to the ceiling brackets to thereby install the lighting system. The ceiling bracket and housing bracket can have openings such that wiring from a junction box can pass into the wireway when no wireway cover blocks access. Safety cables can attach the housing brackets to the ceiling brackets and keep the housing from falling to the floor when the ceiling brackets are not attached to the housing brackets.

It is still yet another aspect of the embodiments that a housing can be wall mounted using wall brackets. The wall brackets can be screwed to a wall. The housing can be attached to the wall brackets using, for example, a T-bolt in a T-channel and a hex nut.

A housing can be suspended from a suspension cable using a cable gripper. A T-end on the cable gripper can be slid into a T-channel and the cable passed through the cable gripper and pulled to a desired length.

The lighting system can use an IMS chassis connector as the electrical connector for passing power and control signals into and out of a luminaire. When using an IMS chassis connector, electrical power can pass via two conductors and control signals can pass via two different conductors. An IMS cable can carry the electric power and control signals to and from the luminaire. As such, the IMS cable has at least four wires that can be electrically connected to four contacts in the IMS chassis connector. The IMS chassis connector thereby provides passing electric power via two wires and passing control signals via two different wires into and out of the luminaire. IMS chassis connectors can be attached to wireway covers and to end caps.

Internal wiring can run through the wireway and pass electric power and control signals between housings. The internal wiring can electrically connect LED arrays, power conditioners, connectors, and external wiring as appropriate for powering and controlling the lighting system. The internal wiring can include a ground wire. The lighting system can be grounded by attaching the ground wire to a fixture bracket.

It is still a yet further aspect of the embodiments that the lighting system can be controlled by a motion sensor. For example, a motion sensor can be mounted on and powered by the LED array's circuit board such that the motion sensor detects movement under the housing. The motion sensor can alternatively be mounted to the LED facing. Upon detecting motion, the motion sensor can trigger or close a switch. The switch, upon closing or being triggered, can complete a circuit to thereby provide power to the LEDs.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

Figure 1:
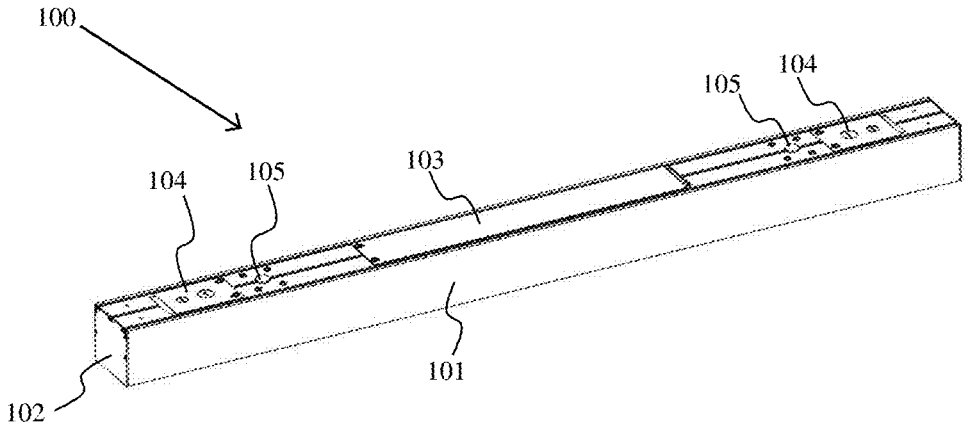
FIG. 1 illustrates a lighting system viewed from above in accordance with aspects of the embodiments.

The particular values and configurations discussed in these non-limiting examples can be varied and are cited merely to illustrate at least one embodiment and are not intended to limit the scope thereof.

For a general understanding of the present disclosure, reference is made to the drawings. In the drawings, like reference numerals have been used throughout to designate identical elements.

A luminaire for architectural, industrial and warehouse applications can be assembled using an extruded housing having flat sides connected by a roof and a cross member. Openings cut into the roof provide access to the wireway below. Nuts slid into T-channels in the roof provide for mounting or suspension via wall brackets, cables, and housing brackets. A threaded nipple accessible through the roof provides for mounting via a pendant stem. Housings can be joined end to end by continuous run brackets. The extrusion can have channels and slots such that certain light engine elements can be slid into the housing and retained by end caps. A housing cover can overlie a wireway while being held in place by screws creating a clamping force between the housing cover and fixture brackets retained within the housing.

Figure 2:
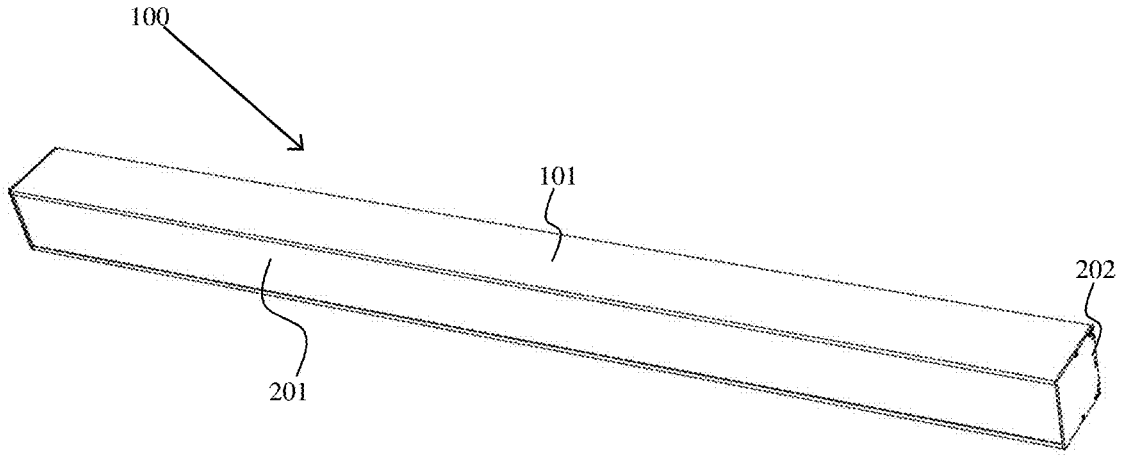
FIG. 2 illustrates a lighting system viewed from underneath in accordance with aspects of the embodiments.
Figure 3:
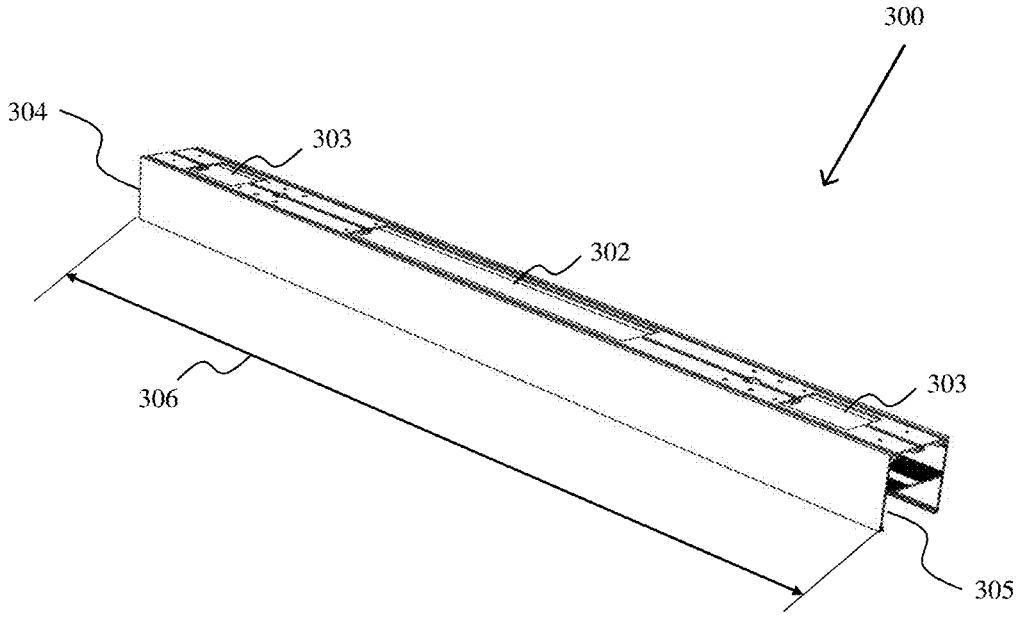
FIG. 3 illustrates an extrusion viewed from above in accordance with aspects of the embodiments.
Figure 4:
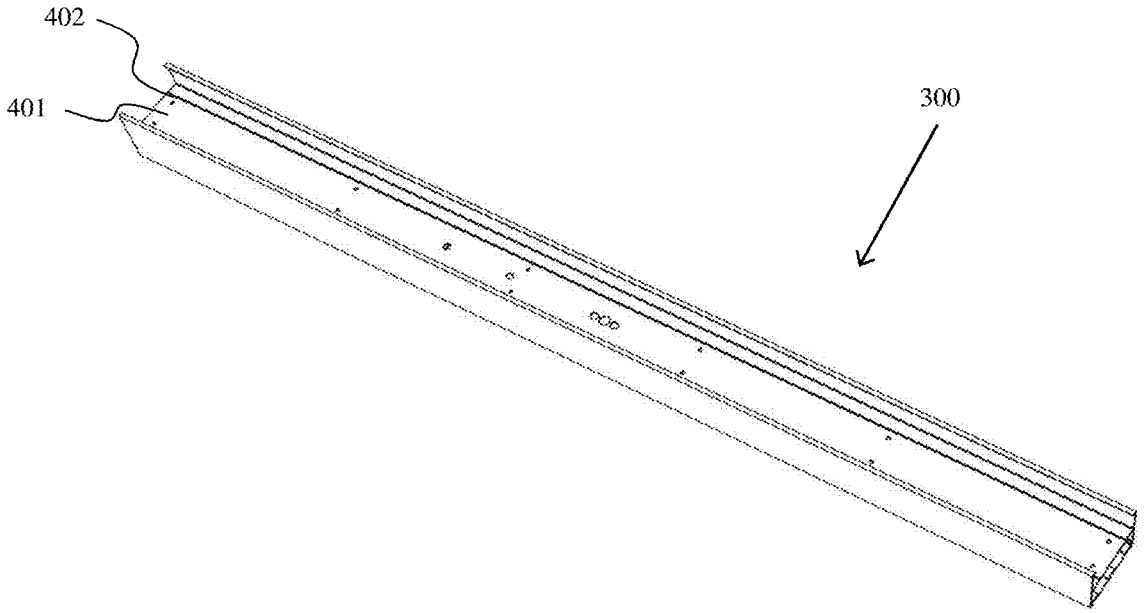
FIG. 4 illustrates an extrusion viewed from below in accordance with aspects of the embodiments.

FIGS. 1 and 2 illustrate a lighting system 100 viewed from above and below, respectively. FIGS. 3 and 4 illustrate an extrusion 300 viewed from above and below, respectively. The illustrated lighting system 100, having a single housing 101, is a single housing system whereas similar lighting systems can have two, three, or more housings joined together. The housing 101 has an extrusion 300 and two end caps 102, 202. A first end cap 102 is attached to the first end 304 of extrusion 300 while a second end cap 202 is attached to the second end 305. The wireway openings 303 are covered by wireway covers 104. A driver cover 103 covers the power block opening 302. A lens 201 allows LED light to exit the bottom of the lighting system 100. The LEDs are attached to an LED array installed against LED array facing 401. Two LED alignment ribs 402 help guide the LED array into the proper position. The extrusion 300 has length 306. The housing's length is the sum of the extrusion's length and the thicknesses of the end caps.

Figure 5:
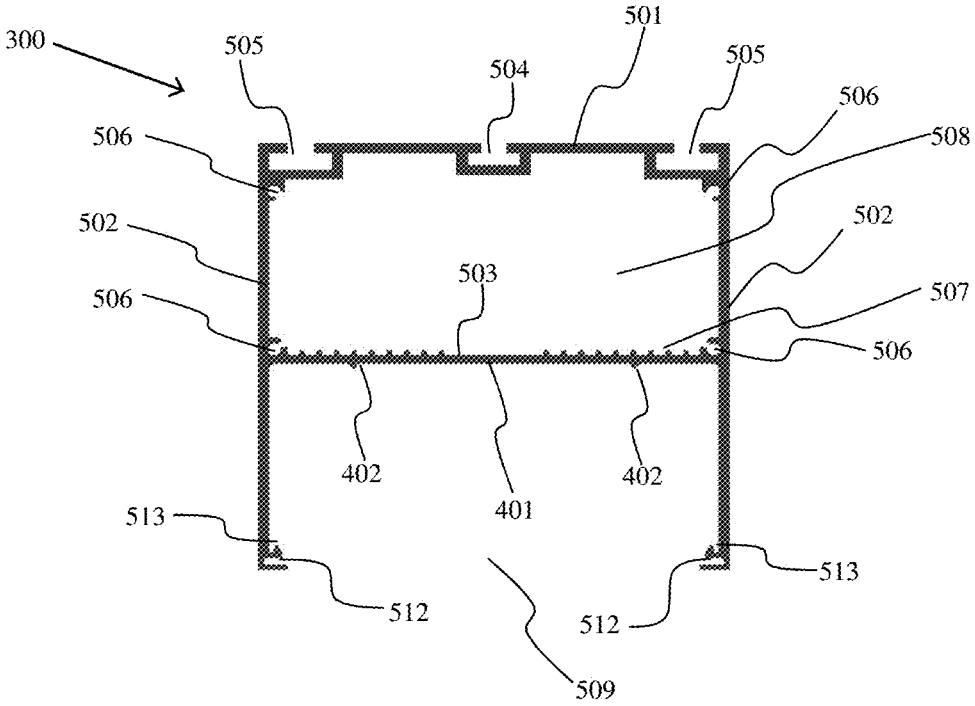
FIG. 5 illustrates an extrusion viewed from the end to show its profile in accordance with aspects of the embodiments.

FIG. 5 illustrates an extrusion 300 viewed from the end to show its profile in accordance with aspects of the embodiments. The profile of an extrusion defines the length running elements of the extrusion. As illustrated, the length running elements include a roof 501, two side walls 502, a cross member 503, a plurality of screw grooves 506, at least one distinct rib array 507, three T-channels 504, 505, an LED array facing 401, two lens slots 512, two LED alignment ribs 402, and two reflector slots 513. The roof 501 and the side walls 502 are seen to be three sides of a rectangle defined by the outer extents of the profile. The cross member 503 bridges the side walls 502 to form a wireway 508 and a bottom cavity 509. There are three T-channels 504, 505 in the roof 501. As illustrated, the T-channels are symmetrically disposed in the roof. The middle channel 504 is centered on the roof 501. The side channels 505 are symmetrically arranged on either side of the center channel 504 and are positioned at the corners of the roof 501 and side walls 502. The end caps 102, 202 can be attached to the extrusion 300 by screws driven into the screw grooves 506. In general, T-channels 504, 505 are all the same size such that they can accommodate the same fixtures and hardware. Embodiments with differing T-channel sizes can accommodate different sized fixtures and hardware in different sized T-channels.

Figure 6:
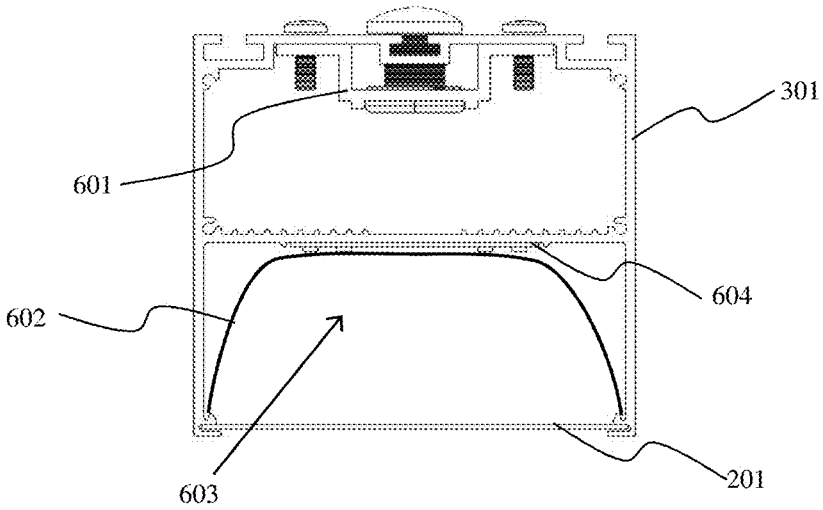
FIG. 6 illustrates an extrusion viewed from the end in accordance with aspects of the embodiments.
Figure 7:
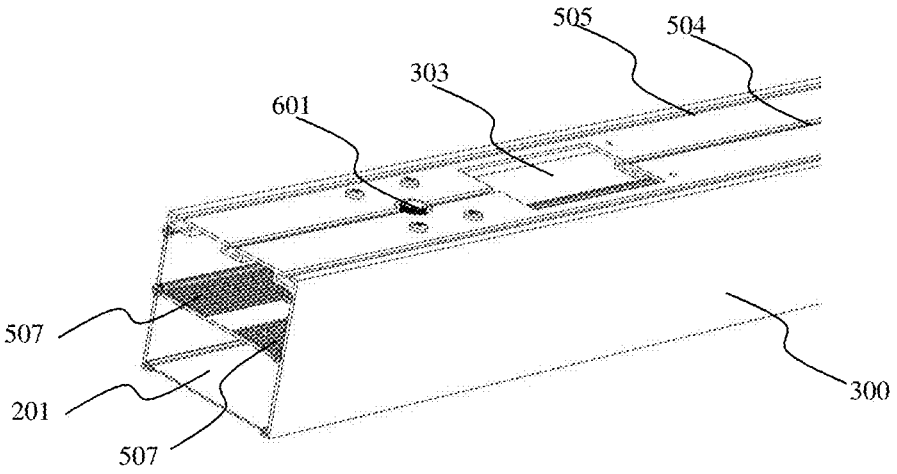
FIG. 7 illustrates another view of an extrusion in accordance with aspects of the embodiments.

FIGS. 6 and 7 illustrate an extrusion 300 in accordance with aspects of the embodiments. Fixture bracket assembly 601 can be seen inside the wireway 508. LED array 604 is attached to the cross member 503 on the LED facing 401 and between the LED alignment ribs 402. The lens 201, which extends from the first end cap 102 to the second end cap 202, is in the lens slots 512. The reflector 602, which also extends from the first end cap 102 to the second end cap 202, is in the reflector slots 513 and is flexed to form a concave reflecting surface 603.

Figure 8:
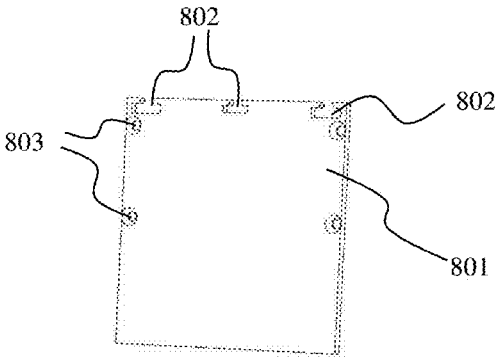
FIG. 8 illustrates an end cap in accordance with aspects of the embodiments.
Figure 9:
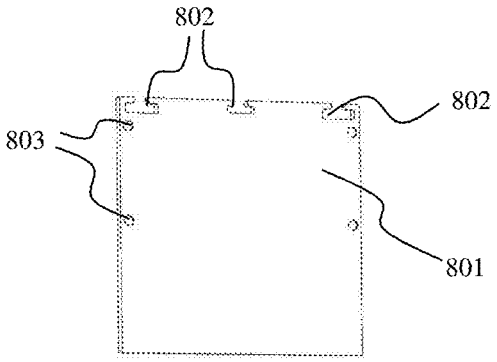
FIG. 9 illustrates another view of the end cap of FIG. 8 in accordance with aspects of the embodiments.

FIGS. 8 and 9 illustrate an end cap 801 in accordance with aspects of the embodiments. The end caps have T-cutouts 802 sized and positioned to act as continuations of the T-channels. The end cap 801 can be attached to an extrusion by driving screws through holes 803 and into screw grooves 506. The holes 803 are countersunk on one side so that the ends of housings, such as housing 101, can lie flush against one another.

Figure 10:
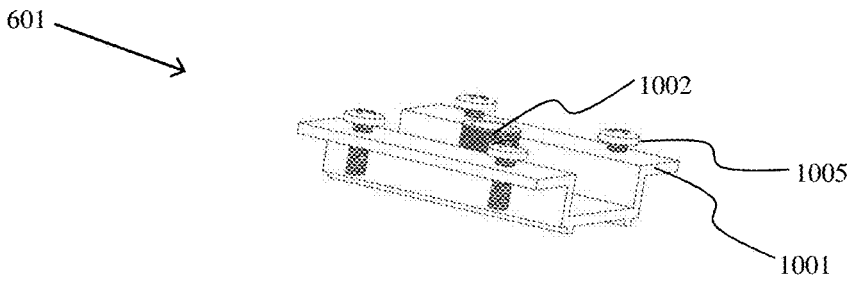
FIG. 10 illustrates a fixture bracket assembly in accordance with aspects of the embodiments.
Figure 11:
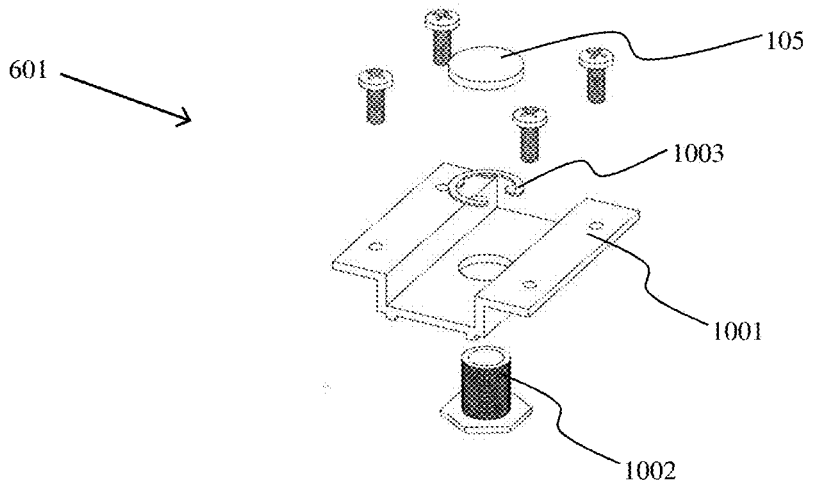
FIG. 11 illustrates an exploded view of the fixture bracket assembly of FIG. 10 in accordance with aspects of the embodiments.

FIG. 10 illustrates a fixture bracket assembly 601 in accordance with aspects of the embodiments. FIG. 11 illustrates an exploded view of the fixture bracket assembly of FIG. 10 in accordance with aspects of the embodiments. Threaded nipple 1002 passes through a hole in the fixture bracket 1001 and is held in place by e-clip 1003. A plastic cap 105 can protect the threaded nipple 1002. The fixture bracket assembly 601 can be attached to the extrusion 300 by screws 1005.

Figure 12:
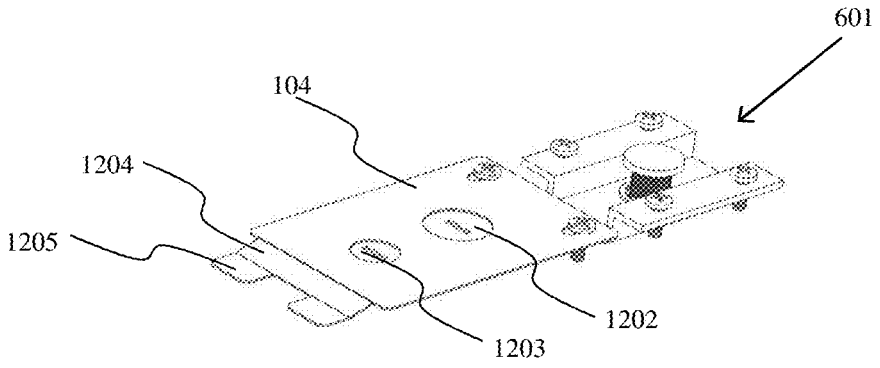
FIG. 12 illustrates a fixture bracket assembly and a wireway cover in accordance with aspects of the embodiments.

FIG. 12 illustrates a fixture bracket assembly 601 and a wireway cover 104 in accordance with aspects of the embodiments. The wireway cover 104 has two knockouts 1202, 1203 of different sizes to accommodate different sized electric cables or cable bushings. A downward bend 1204 and tabs 1205 can hold one end of the wireway cover 104 in a wireway opening 303 while the other end is fixed in place by screws.

Figure 13:
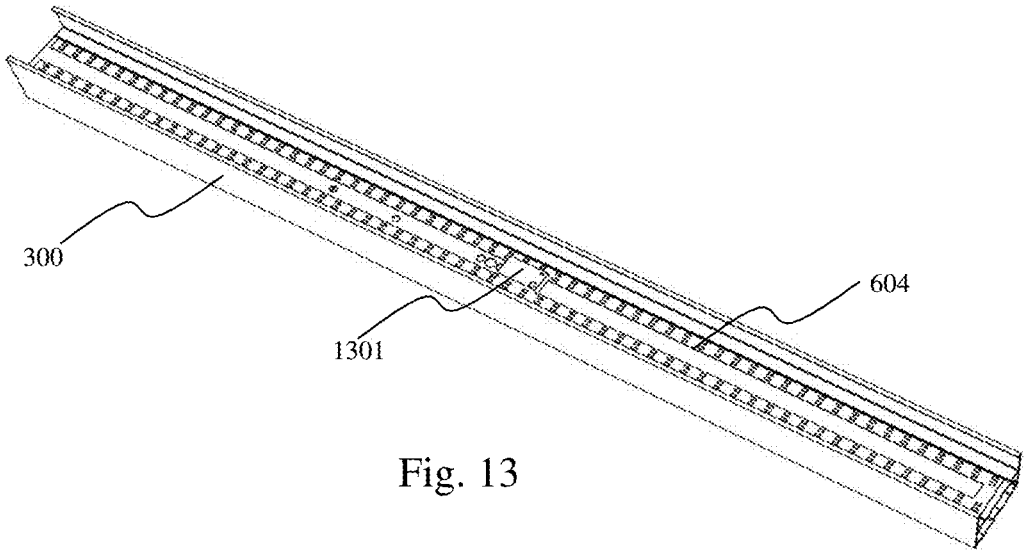
FIG. 13 illustrates an extrusion with an LED array in accordance with aspects of the embodiments.

FIG. 13 illustrates an extrusion 300 with an LED array 604 in accordance with aspects of the embodiments. A motion sensor 1301 can detect motion under the lighting system 100 and cause the LEDs 1404 to illuminate.

Figure 14:
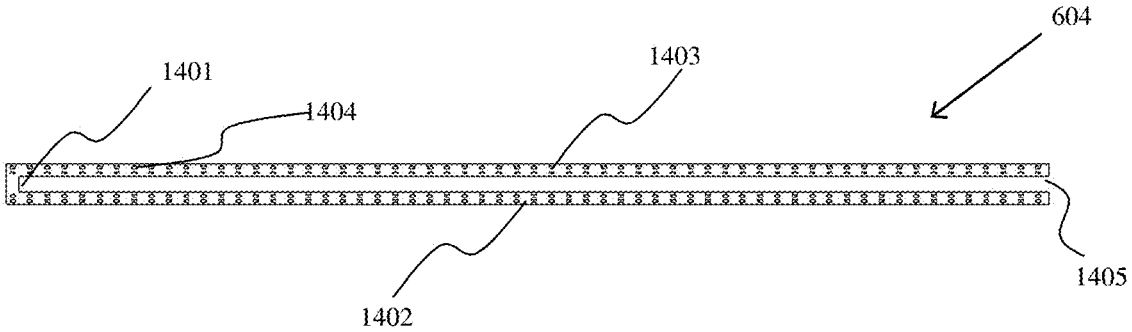
FIG. 14 illustrates a LED array in accordance with aspects of the embodiments.

FIG. 14 illustrates a LED array 604 in accordance with aspects of the embodiments. The LED array, having a u-shaped circuit substrate, is U-shaped with a cutout 1405 between the legs 1402, 1403 of the LED array 604. A bridge 1401 joins the first leg 1402 to the second leg 1403. The illustrated LED array has LEDs 1404 arranged in two double rows for a total of four rows of LEDs. Each leg 1402, 1403 has one of the double rows of LEDs 1404. Other embodiments can have a single row of LEDs on each leg.

Figure 15:
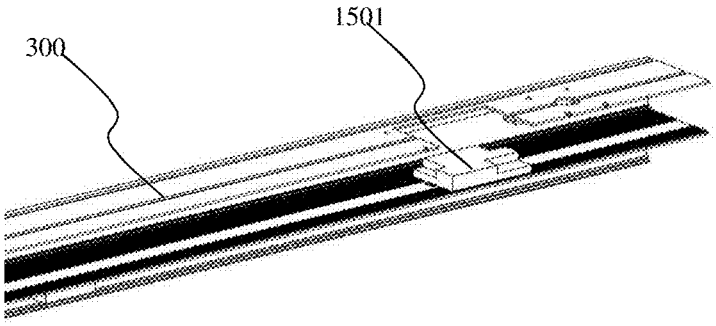
FIG. 15 illustrates a control block in an extrusion in accordance with aspects of the embodiments.

FIG. 15 illustrates a control block 1501 in an extrusion 300 in accordance with aspects of the embodiments. The motion sensor 1301 can detect motion and send a signal to the control block 1501. The control block 1501 can then turn on the LEDs 1404.

Figure 16:
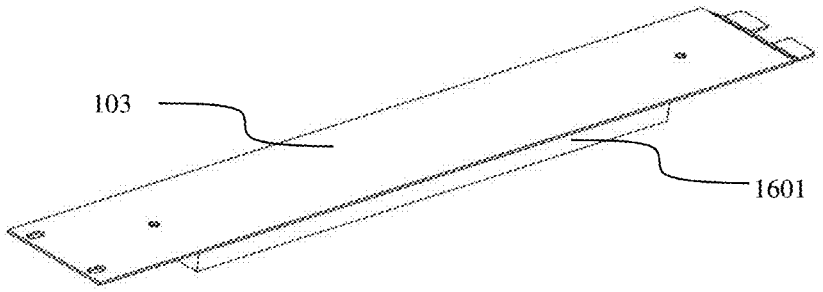
FIG. 16 illustrates a driver cover and power conditioner in accordance with aspects of the embodiments.
Figure 17:
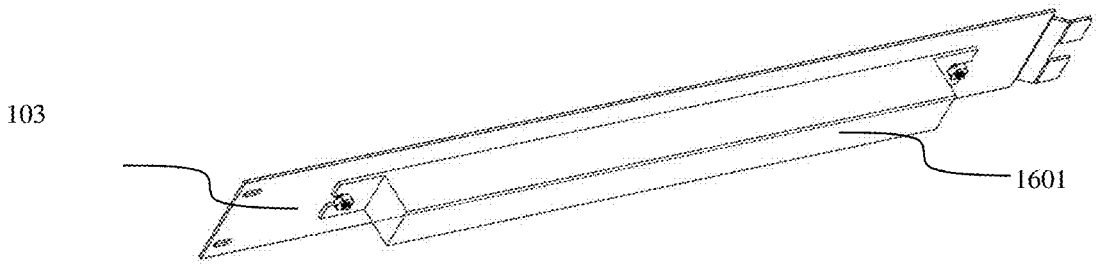
FIG. 17 illustrates another view of the driver cover and power conditioner of FIG. 16 in accordance with aspects of the embodiments.

FIGS. 16 and 17 illustrate a driver cover 103 and power conditioner 1601 in accordance with aspects of the embodiments. The power conditioner 1601 can be attached to the driver cover 103 by hex nuts to the underside of the driver cover 103. When installed, the power conditioner 1601 is in the wireway 508.

Figure 18:
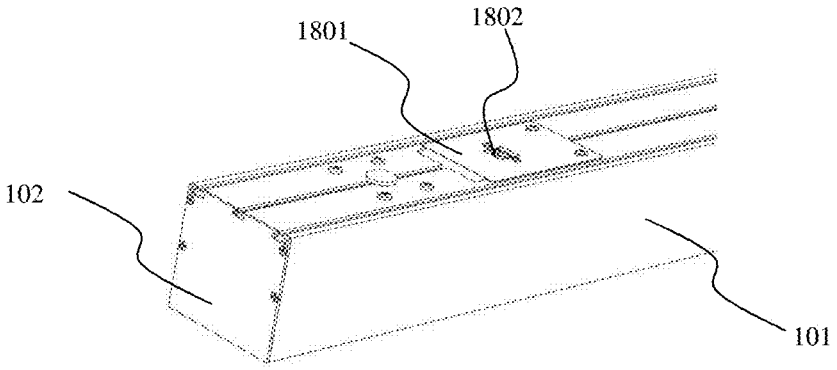
FIG. 18 illustrates a housing with a connector in accordance with aspects of the embodiments.

FIG. 18 illustrates a housing 101 with a connector in accordance with aspects of the embodiments. The connector can be accessed through a hole 1802 in a wireway cover 1801.

Figure 19:
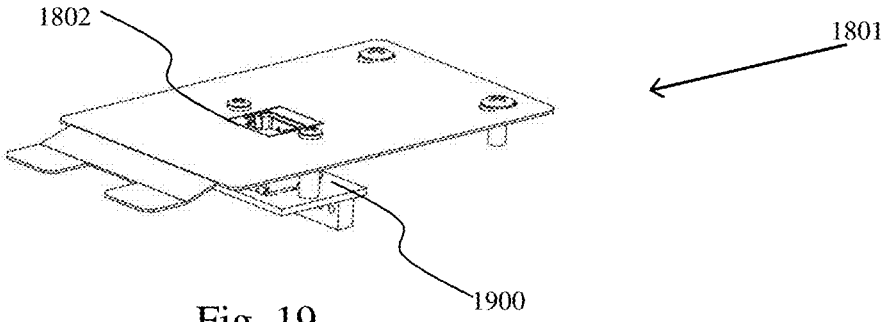
FIG. 19 illustrates a wireway cover with a connector in accordance with aspects of the embodiments.

FIG. 19 illustrates a wireway cover 1801 with a connector in accordance with aspects of the embodiments. The illustrated connector is a RJ45 socket 1901 of a RJ45 connector assembly 1900.

Figure 20:
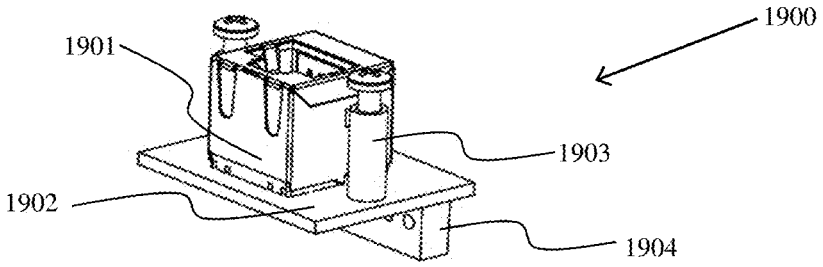
FIG. 20 illustrates a RJ45 connector assembly in accordance with aspects of the embodiments.

FIG. 20 illustrates a RJ45 connector assembly 1900 in accordance with aspects of the embodiments. The RJ45 connector assembly 1900 has a RJ45 socket 1901 and internal connector 1904 connected to a circuit board 1902. The assembly 1900 can be attached to a wireway cover 1801 by screws driven into standoffs 1903. Internal wiring can be connected to connector 1904 to pass electric power and control signals received by the RJ45 socket to internal electric components such as the LED array 604, power conditioner 1601, motion sensor 1301, or control block 1501.

Figure 21:
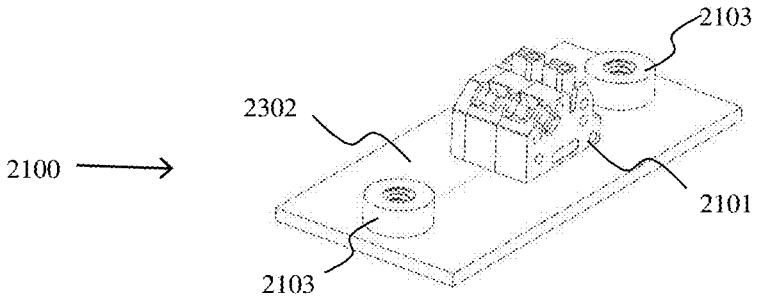
FIG. 21 illustrates a terminal block assembly in accordance with aspects of the embodiments.

FIG. 21 illustrates a terminal block assembly 2100 in accordance with aspects of the embodiments. The terminal block assembly 2100 has a terminal block 2101, circuit board 2302, and standoffs 2103. The terminal block assembly can be attached to a wireway cover 1801 by screws driven into the standoffs 2103. Internal wiring can be connected to the circuit board 2302 at pads, through-holes, or pins that are in, on, or extending from the circuit board 2302. The illustrated terminal block 2101 is a two-wire terminal block and is not intended to limit the embodiments to two wires because three four and five wire embodiments can provide connections for a power line, a power return line, a signal line, a signal return line, and a ground line. Internal wiring connected to terminal block assembly 2100 can pass electric power and control signals received by the terminal block 2101 to internal electric components such as the LED array 604, power conditioner 1601, motion sensor 1301, or control block 1501.

Figure 22:
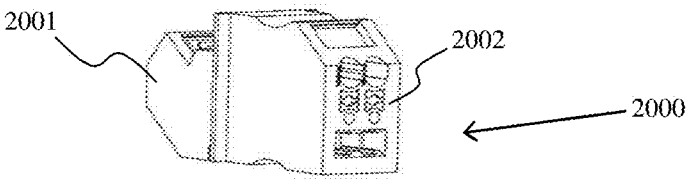
FIG. 22 illustrates another view of the panel feedthrough terminal block of FIG. 21 in accordance with aspects of the embodiments.

FIGS. 21 and 22 illustrate a panel feedthrough terminal block 2000 in accordance with aspects of the embodiments. The panel feedthrough terminal block 2000 has an internal end 2002 and an external end 2001. The panel feedthrough terminal block 2000 can electrically connect external wires to internal wires. The external wires can carry power and signals to the lighting system 100. The internal wires, being inside the lighting system 100, can carry power and signals inside the lighting system 100. The panel feedthrough terminal block 2000 can be installed in a lighting system 100 by fitting it into an opening such as opening 1802.

Figure 23:
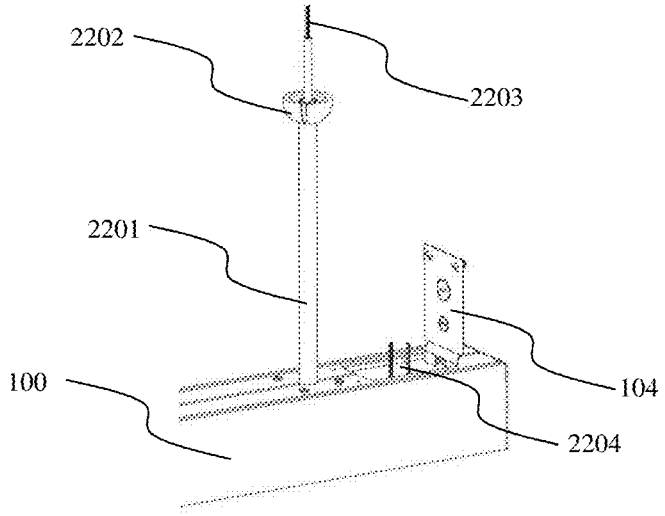
FIG. 23 illustrates a lighting system with a pendant stem in accordance with aspects of the embodiments.

FIG. 23 illustrates a lighting system 100 with a pendant stem 2201 in accordance with aspects of the embodiments. The pendent stem 2201 has been threaded onto the threaded nipple 1002 of an installed fixture bracket assembly 601. External wiring 2203 can pass through the pendent stem 2201 and into the lighting system 100 to join internal wiring 2204 in passing electric power and control signals inside the lighting system 100. A swivel ball 2202 attached to the pendent stem 2201 can interface with brackets to thereby install the lighting system.

Figure 24:
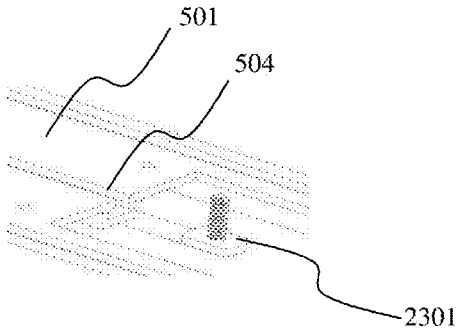
FIG. 24 illustrates a T-bolt entering a T-channel in accordance with aspects of the embodiments.

FIG. 24 illustrates a T-bolt 2301 entering a T-channel 504 in accordance with aspects of the embodiments. The T-bolt is sized so that it can slide into T-channel 504 but cannot rotate within T-channel 504.

Figure 25:
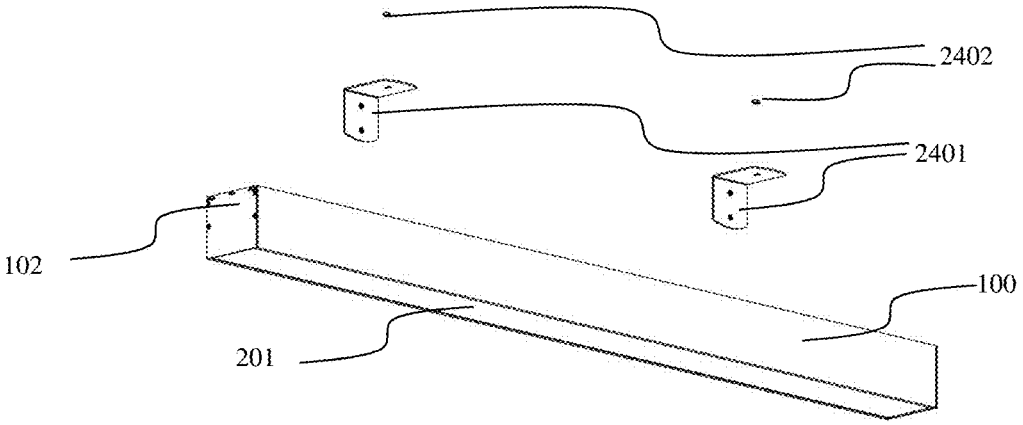
FIG. 25 illustrates a lighting system with wall mount brackets in accordance with aspects of the embodiments.

FIG. 25 illustrates a lighting system 100 with wall mount brackets 2401 in accordance with aspects of the embodiments. T-bolts 2301 in T-channels 504, 505 can pass through holes in the wall mount brackets 2401 and be fixed in place by hex nuts 2402. The lighting system 100 is thereby installed against a wall if the wall mount brackets 2401 are attached to the wall.

Figure 26:
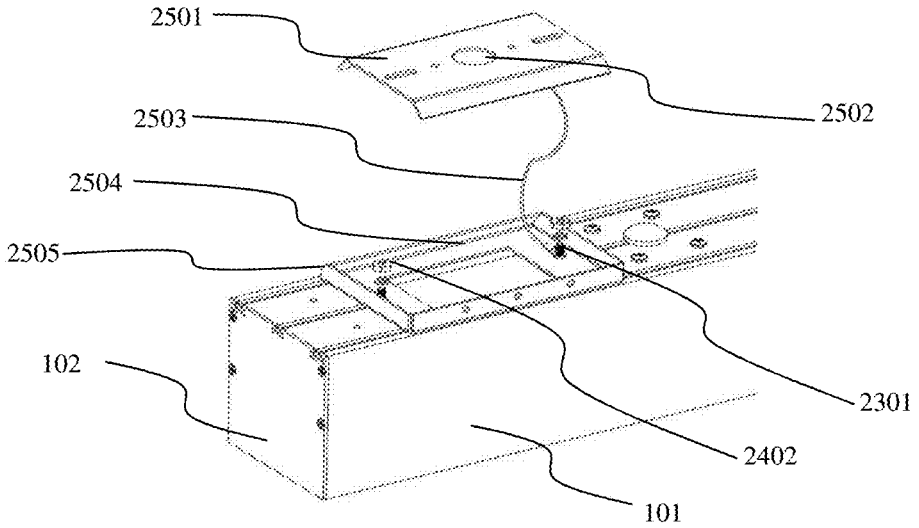
FIG. 26 illustrates a ceiling bracket and housing bracket in accordance with aspects of the embodiments.
Figure 27:
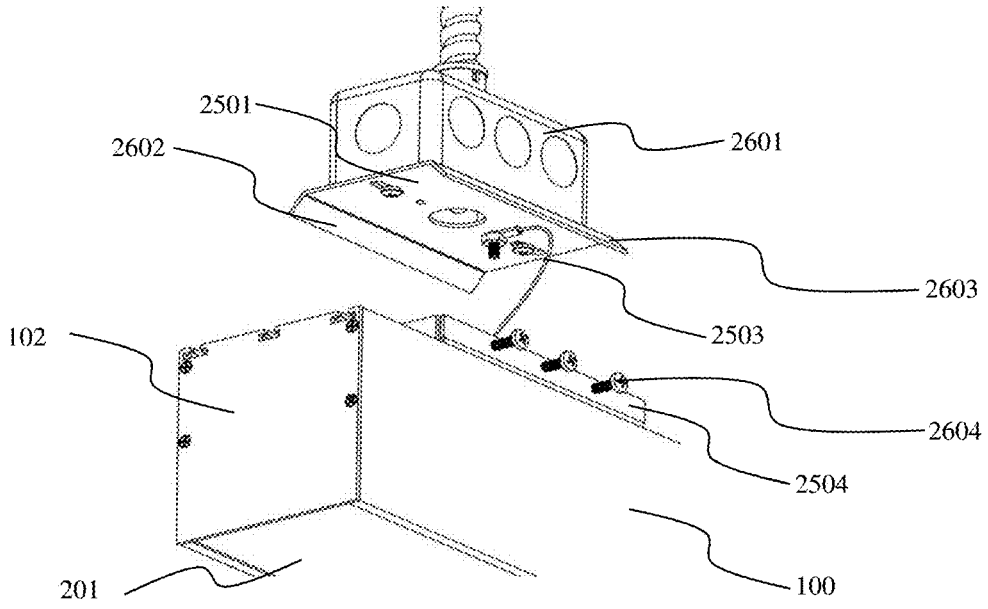
FIG. 27 illustrates another view of the ceiling bracket and housing bracket of FIG. 26 in accordance with aspects of the embodiments.

FIGS. 26 and 27 illustrate a ceiling bracket 2501 and housing bracket 2504 in accordance with aspects of the embodiments. The housing bracket 2504 can be attached to the housing 101 using T-bolts 2301 and hex nuts 2402. Ceiling bracket 2501 can be attached to a ceiling or junction box 2601. Wires from the ceiling or junction box 2601 can pass through a hole 2502 in the ceiling bracket 2501 and then into the wireway opening of the housing 101. A safety cable 2503 connected to ceiling bracket 2501 and housing bracket 2504 keeps the housing 101 aloft when the ceiling bracket 2501 and housing bracket 2504 are not directly attached to one another. The ceiling bracket 2501 and housing bracket 2504 can be directly attached by placing mating flange 2602 inside housing bracket 2504 and against angled side 2505. Held flange 2603 can then be placed inside the housing bracket 2504 and screws 2604 tightened to hold ceiling bracket 2501 and housing bracket 2504 together.

Figure 28:
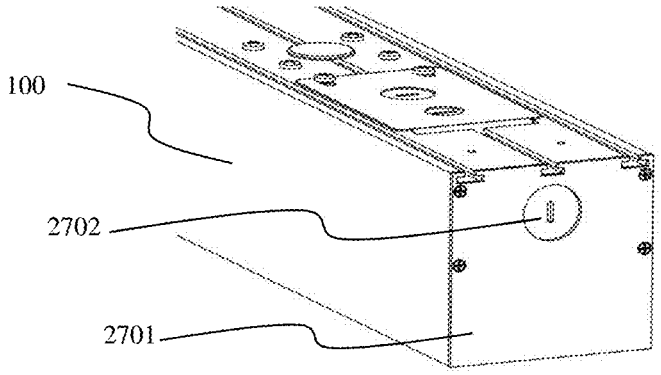
FIG. 28 illustrates a lighting system having an end cap with a knockout in accordance with aspects of the embodiments.
Figure 29:
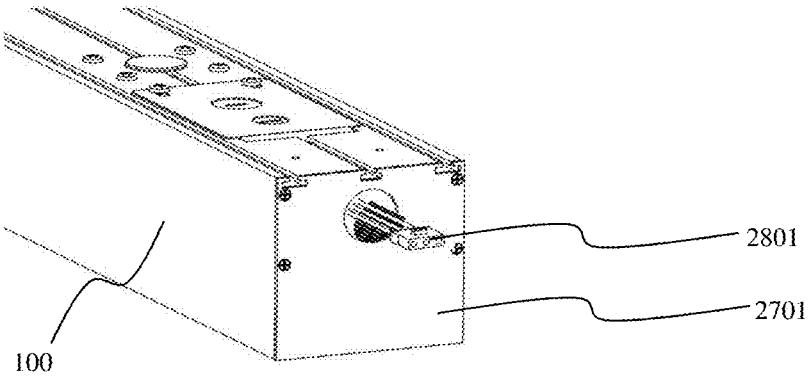
FIG. 29 illustrates the lighting system of FIG. 28 with the knockout removed or knocked out in accordance with aspects of the embodiments.

FIGS. 28 and 29 illustrate a lighting system 100 having an end cap 2701 with a knockout 2702 in accordance with aspects of the embodiments. Internal wiring 2801 can be accessed when knockout 2702 is removed, thereby giving access to the wireway.

Figure 30:
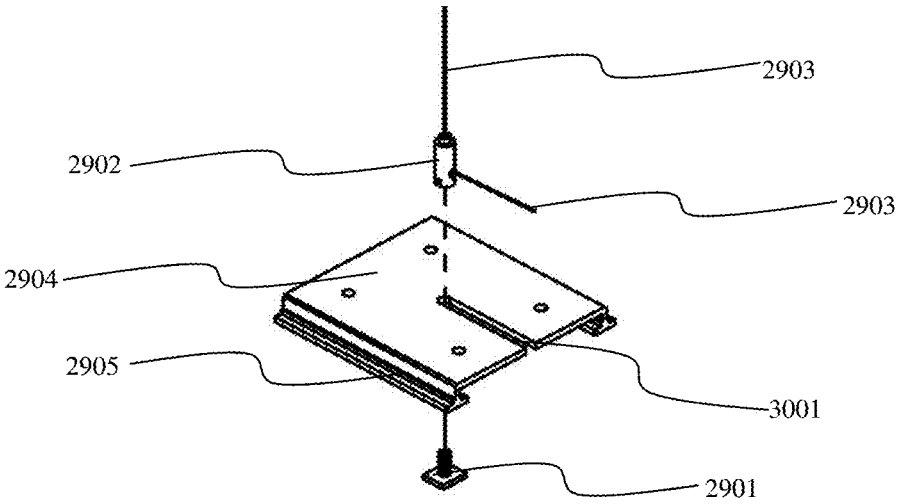
FIG. 30 illustrates a continuous run bracket in accordance with aspects of the embodiments.

FIG. 30 illustrates a continuous run bracket 2904 in accordance with aspects of the embodiments. The continuous run bracket 2904 has T-rails 2905 that can slidably engage the T-channels 505 of a housing 101. As with T-bolts, the shape of the T-rails allows them to slide into the T-channel but to be limited to movement in one dimension, lengthwise, in the channel. A suspension cable 2903 passes through a cable gripper 2902 and can be adjusted by releasing the cable gripper's grip. A T-end 2901 can pass through a bracket channel 3001 in continuous run bracket 2904 and be attached to the cable gripper 2902. The T-end can also be sized to slidably engage the T-channels 504, 505 such that a housing can be directly suspended from a suspension cable 2903. Lighting systems 100 can be suspended from suspension cables 2903 attached to continuous run brackets 2904 engaging housings 101.

Figure 31:
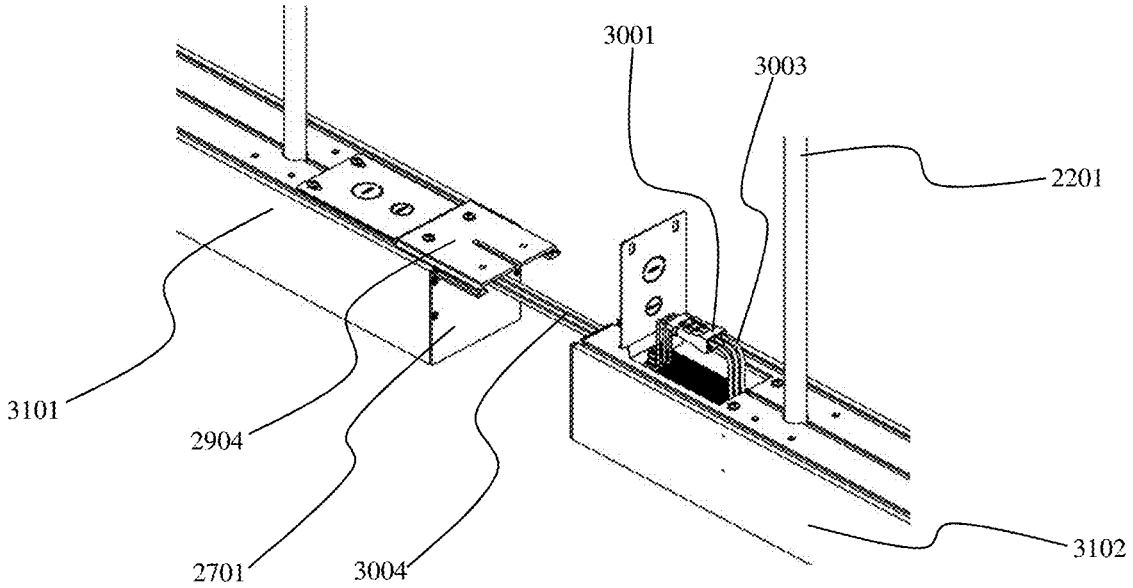
FIG. 31 illustrates a continuous run bracket and two housings in accordance with aspects of the embodiments.
Figure 32:
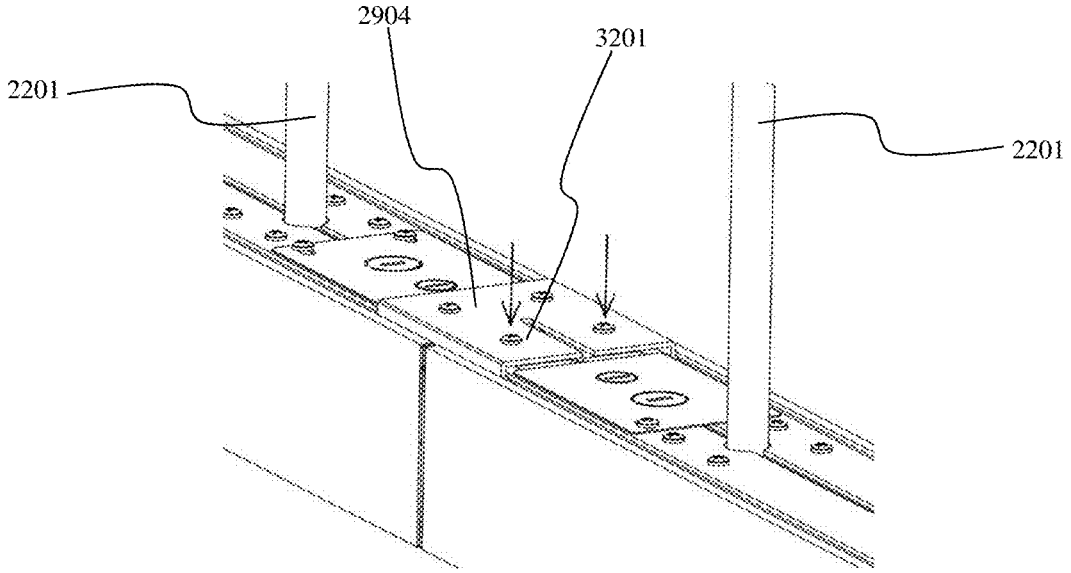
FIG. 32 illustrates a continuous run bracket joining two housings in accordance with aspects of the embodiments.

FIGS. 31 and 32 illustrate a continuous run bracket 2904 joining two housings 3101, 3102 in accordance with aspects of the embodiments. Both housings 3101, 3102 have internal wireways. Both housings 3101, 3102 have end caps 2701 with knocked out knockouts 2702 such that internal wiring 2801, 3003, 3004 can pass through the entire wireway that is formed when the housings 3101, 3102 are joined. The internal wiring of the two housings can be joined by internal connectors 3001. The illustrated two housing lighting system has its internal wiring joined such that both housings share electric power and control signals. The housings 3101, 3102 are joined when continuous run bracket 2904 slidably engages the T-channels of both housings and is then fixed in place. The illustrations show screws 3201 fixing continuous run bracket 2904 to both housings. The illustrated two housing lighting system is configured for being suspended from pendent stems 2201.

Figure 33:
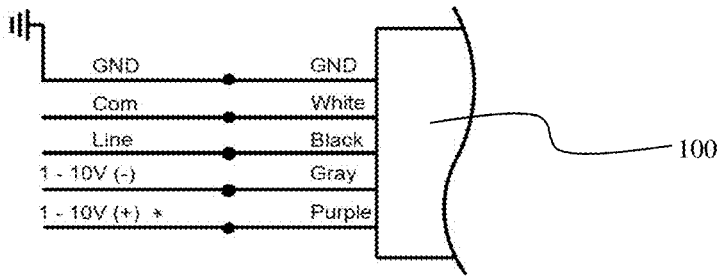
FIG. 33 illustrates a wiring diagram for an electric cable in accordance with aspects of the embodiments.

FIG. 33 illustrates a wiring diagram for an electric cable in accordance with aspects of the embodiments. Electric power can be carried by the "Com" and "Line" wires while control signals can be carried by the 1-10V(−) and 1-10V(+) wires. 1-10V is a standardized lighting control protocol. GND is the ground wire that electrically grounds the lighting system 100. As discussed above, attaching GND to a fixture bracket can ground the lighting system. This is because the illustrated embodiments use an aluminum fixture bracket that is screwed directly to the aluminum extrusion of the housing. For clarity, it has not been pointed out until now that embodiments having extruded aluminum fixture brackets have been deployed. Experimentation has revealed that it is advantageous to attach the ground wire to an internally mounted conducive component like the fixture bracket because it eases the attachment and detachment of electrical ground.

Figure 34:
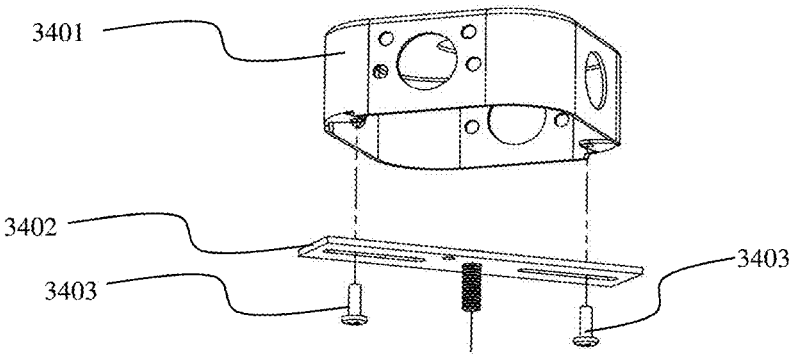
FIG. 34 illustrates attaching a crossbar to a junction box in accordance with aspects of the embodiments.
Figure 35:
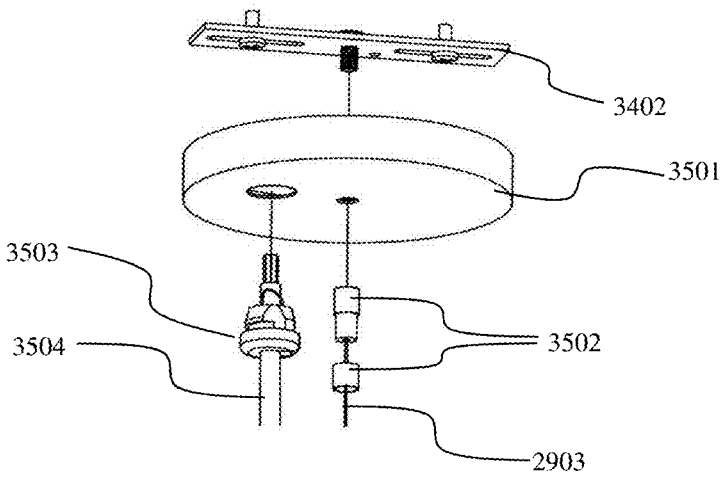
FIG. 35 illustrates suspending elements from a crossbar in accordance with aspects of the embodiments.
Figure 36:
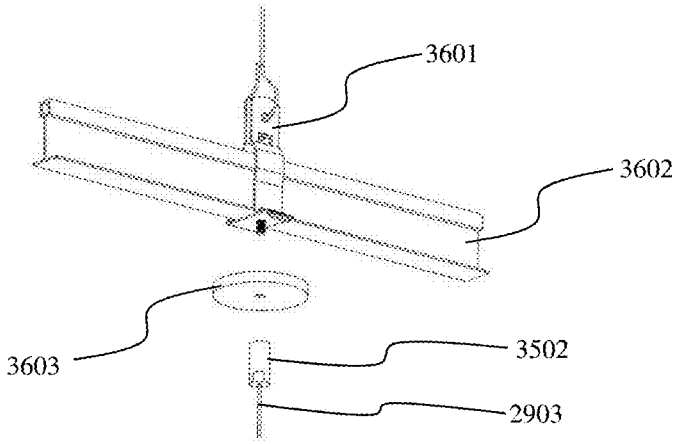
FIG. 36 illustrates suspending elements from a main tee in accordance with aspects of the embodiments.
Figure 37:
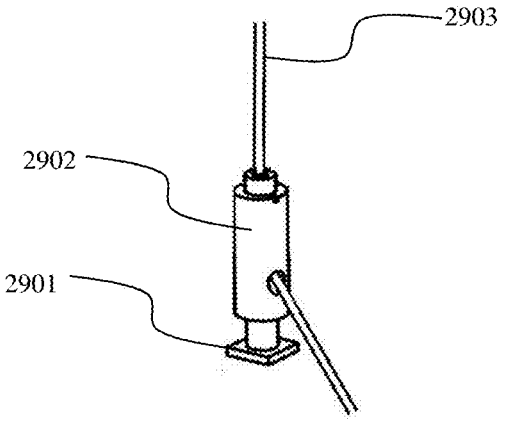
FIG. 37 illustrates a grip lock with a suspension cable in accordance with aspects of the embodiments.
Figure 38:
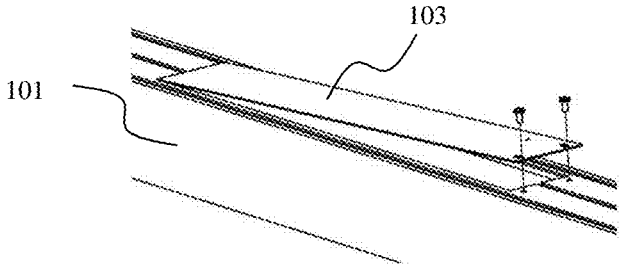
FIG. 38 illustrates lifting a driver cover from a housing in accordance with aspects of the embodiments.

FIGS. 34-41 illustrate steps for deploying a luminaire by suspending it from suspension cables 2903. FIGS. 34, 35, 40, and 41 are directed to aspects wherein external wiring is passed to the luminaire. FIGS. 36, 38, are directed to aspects wherein a suspension cable is installed. Installing a single luminaire using suspension cables generally requires that a suspension cable and external wiring be deployed to one side of the luminaire while only a suspension cable is deployed to the other side. Continuous run installations (See FIGS. 28-32) generally require numerous suspension cables such as that of FIG. 30 and a single deployment of external wiring that passes into the wireway of one of the continuous run luminaires.

FIGS. 34 and 35 illustrate a crossbar 3402 being attached to a junction box 3401 by two screws 3403. A cable coupler 3502 can couple a suspension cable 2903 to the crossbar 3402 and can also fix a power feed canopy 3501 in position under the crossbar 3402. External wiring 3504, also called a power feed cable, can be attached to the power feed canopy 3501 using a cable bushing 3503. The power feed cable 3504 can be connected to wiring inside the junction box 3401.

FIG. 36 illustrates attaching a suspension cable 2903 to a main T 3602. The main T 3602 is part of a building such as a building having drop ceilings. A drop ceiling bracket 3601 can be attached to the main T 3602. A cable coupler 3502 can attach a suspension cable 2903 to the drop ceiling bracket 3601 and can also hold a canopy 3603 under the drop ceiling bracket 3601.

FIG. 37 illustrates a cable gripper 2902, often called a grip lock, that engages a suspension cable 2903. Cable grippers 2902 can be used wherever there is a need to adjust the length of any of the cables suspending a luminaire. As discussed previously, a T end 2901, also called a T bolt, can slidably engage a T-channel 504 in a housing 101.

Figure 39:
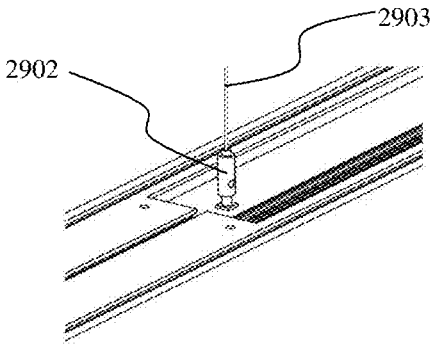
FIG. 39 illustrates joining a grip lock and a housing in accordance with aspects of the embodiments.

FIGS. 38 and 39 show steps for slidably engaging a cable gripper 2902 and a T-channel 504. The driver cover 103 is lifted in order to access the T-channel 504. The T-bolt 2901 is then slid into the T-channel. The steps illustrated in FIGS.

36-39 can suspend a portion of a luminaire but do not provide power or control signals to the luminaire.

Figure 40:
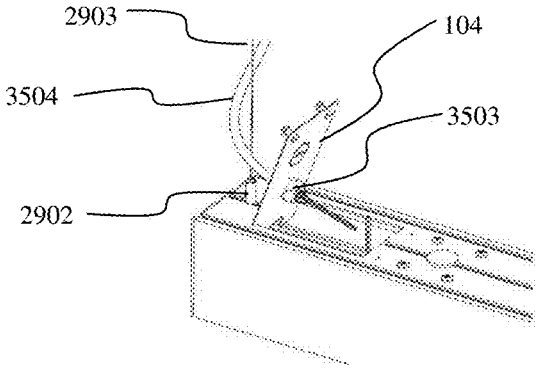
FIG. 40 illustrates passing wiring into a wireway in accordance with aspects of the embodiments.
Figure 41:
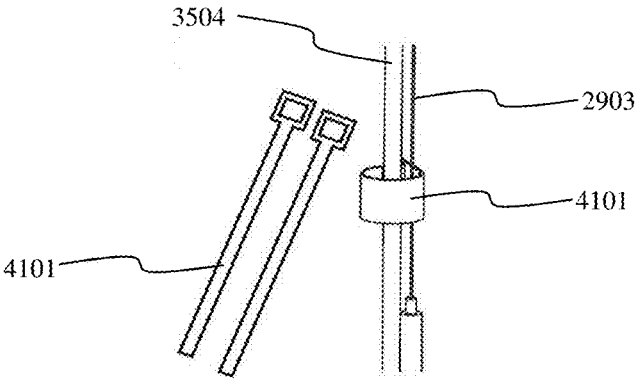
FIG. 41 illustrates securing a power feed cable to a suspension cable in accordance with aspects of the embodiments.

FIG. 40 illustrates suspending a powered end of a luminaire. A cable gripper 2902 is engaging the T-channel 504, thereby suspending the end of the luminaire from suspension cable 2903. Power feed cable 3504 is attached to wireway cover 104 by cable bushing 3503. Wiring from the power feed cable 3504 is seen entering the wireway where it can be connected to wires inside the luminaire. FIG. 41 illustrates tidying the installation by securing the power feed cable 3504 to the suspension cable 2903 using a wire tie 4101.

Figure 42:
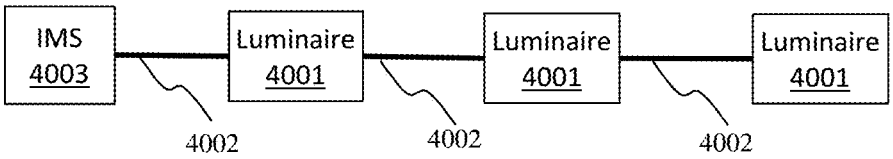
FIG. 42 illustrates an Illumination Management System (IMS) powering and controlling four luminaires in accordance with aspects of the embodiments.

FIG. 42 illustrates an Illumination Management System (IMS) 4003 powering and controlling four luminaires 4001 in accordance with aspects of the embodiments. An IMS 4003 can use IMS cables 4002 to provide power and control to the luminaires 4001. As shown in FIG. 25, the luminaires 4001 can be daisy chained with the IMS 4003 providing power and control signals to a first luminaire, the first luminaire passing the power and control signals to a second luminair, and so forth. An IMS can be connected to a building's mains power (e.g. 120 VAC or 240 VAC) and can produce conditioned DC power usable by the luminaires. IMS based lighting systems are advantageous because large AC-to-DC power blocks can be placed in the IMS such that the luminaires can be powered by small and inexpensive LED drivers that accept DC power and provide constant current power to the LEDs. The IMS can also control the luminaires by providing control signals.

Figure 43:
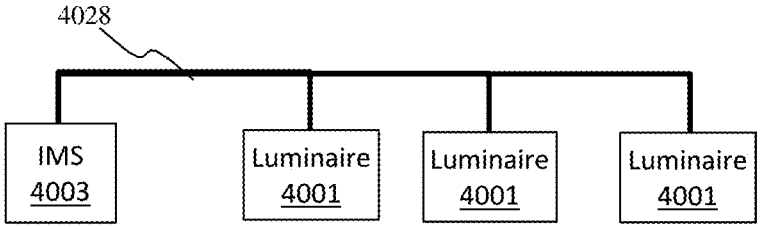
FIG. 43 illustrates an IMS powering and controlling four luminaires in accordance with aspects of the embodiments.

FIG. 43 illustrates an IMS 4003 powering and controlling four luminaires 4001 in accordance with aspects of the embodiments. Here, the IMS 4003 is connected to the luminaires by a multidrop IMS cable 4028 such that each of the luminaires 4001 receives power and control signals directly from the IMS 4003.

Figure 44:
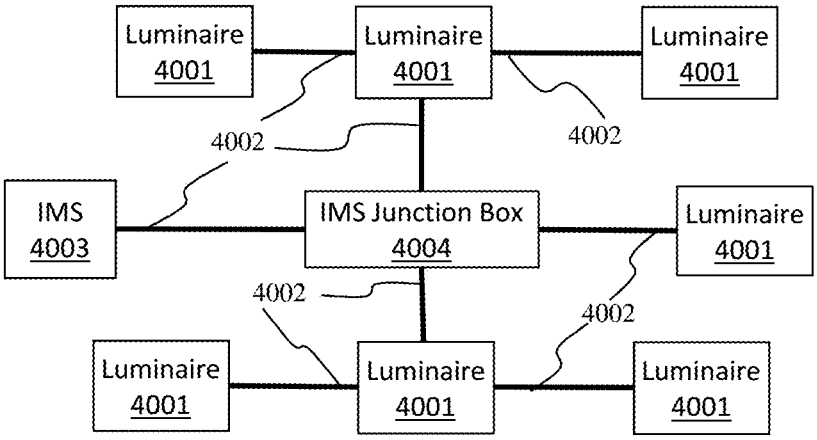
FIG. 44 illustrates an IMS powering and controlling seven luminaires in accordance with aspects of the embodiments.

FIG. 44 illustrates an IMS 4003 powering and controlling seven luminaires 4001 in accordance with aspects of the embodiments. The IMS 4003 is connected directly to an IMS junction box 4004 that distributes the power and control signals directly to three of the luminaires 4001. The remaining four luminaires 4001 receive the power and control signals directly from other luminaires. Alternatively, a multidrop IMS cable 4028 can be used instead of the combination of IMS cables 4002 and IMS junction box 4004.

Figure 45:
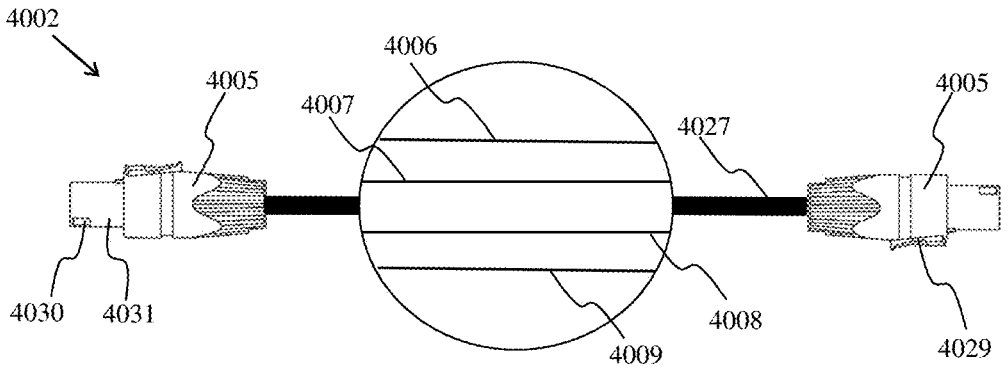
FIG. 45 illustrates an IMS cable in accordance with aspects of the embodiments.

FIG. 45 illustrates an IMS cable 4002 in accordance with aspects of the embodiments. IMS cable connectors 4005 are connected to either end of a four-conductor cable 4027. Two of the wires 4006, 4007 in the cable carry DC power with one wire 4006 being power (often labeled V+) and the other wire 4007 being the return line (often labeled V−). The other two wires 4008 and 4009 carry control signals. For example, the Digital Addressable Light Interface (DALI) is a well-known lighting standard that carries power and control signals over two wires with one called "+DALI bus" and the other called "−DALI bus". DALI, however, is limited to a maximum voltage of 22 VDC and a maximum current of 250 mA. The IMS system can therefor use DALI for control signaling on wires 4008 and 4009 while power is carried on wires 4006 and 4007. The IMS can provide 48 VDC at over 30 A which can be provided to the luminaires over wires 4006 and 4007. In practice, the IMS has operated with an output between 40 VDC and 52 VDC although 48 VDC plus/minus 1 VDC operation is preferred such that luminaires near the IMS do not receive too much voltage while luminaires far from the IMS, which can see less voltage due to transmission loss, receive enough voltage.

In this non-limiting example, the four conductors of cable 4027 are carrying V+, V−, +DALI, and −DALI. Wire 4006 carries V+. Wire 4007 carries V−. Wire 4008 carries +DALI. Wire 4009 carries −DALI.

Experimentation has shown that some connectors are advantageous when installing and operating a lighting system such as those of FIGS. 42-44 and especially for those installations having tens or hundreds of luminaires. Such systems are common in warehouses and data centers. The connectors should be installable by feel and should lock in place when properly installed. These properties are important because the connectors will often be manipulated by people on ladders and without a clear view (or with no view) of the operation they are trying to accomplish. For this reason, the IMS cable connector 4005 is shown as a Neutrik NL4FX cable connector which provides four electrical connections, a tactilely intuitive lock/release mechanism, and alignment keys. The Neutrik NL4FX pairs with chassis connectors 4010 such as the Neutrik NL4MD shown in FIGS. 46-53. The IMS cable connector 4005 can be installed in a IMS chassis connector 4010 by aligning its outer cylinder 4031 with the IMS chassis connector's cylindrical hole 4032, rotating until the key 4030 aligns with the IMS chassis connector's keyway 4034, and then pressing the IMS cable connector 4005 into the IMS chassis connector 4010 until the locking mechanism 4029 engages the IMS chassis connector's lock engagement 4033. These operations are easy to perform blind. Not shown is the IMS cable connector's center rod which fits in the IMS chassis connector's central hole 4035 when the IMS cable connector 4005 is installed in the IMS chassis connector 4010.

Figure 46:
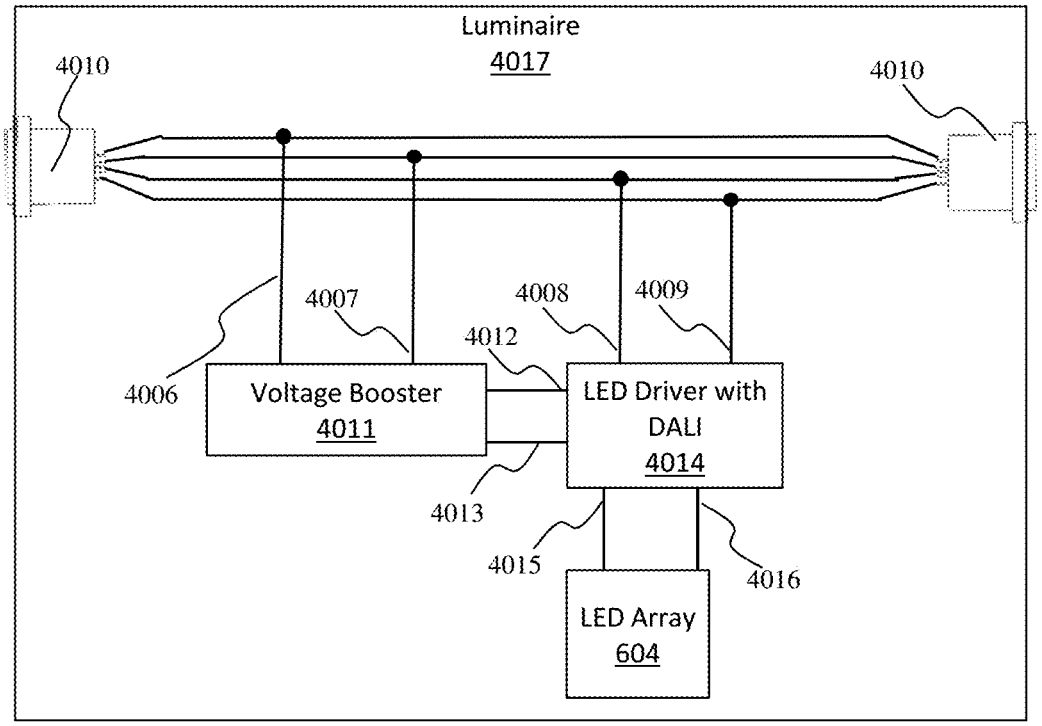
FIG. 46 illustrates a luminaire configured for power and control by an IMS in accordance with aspects of the embodiments.

FIG. 46 illustrates a luminaire 4017 configured for power and control by an IMS in accordance with aspects of the embodiments. The illustrated chassis connectors 4010 are the Neutrik NL4MD which mates with the NL4FX. V+ 4006 and V− 4007 are electrically connected to voltage booster 4011 which can provide a specified power on lines 4012, 4013 to the LED Driver 4014. +DALI 4008 and −DALI 4009 provide control signaling to the LED driver 4014. The LED driver 4014 powers the LED array 604 via LED power lines 4015, 4016. Being DALI enabled, LED driver 4014 is addressable such it can be commanded to turn LED array 604 on, off, or dimmed, etc. A single luminaire can have multiple LED drivers and LED arrays, each individually addressable and controllable via DALI. Although the DALI control signals can be provided by any device connected to the +DALI and −DALI lines, the IMS can house controllers that are accessible over the internet and that produce DALI signaling for the luminaires. This non-limiting example uses DALI instead of other two-wire control signaling protocols such as "0-10" (superseded by DALI).

The voltage booster 4011 accepts DC power at one voltage and outputs DC power at a higher voltage. Those practiced in the electronics arts are familiar with numerous appropriate circuits such as boost converters, DC-DC converters, etc.

The LED driver 4014 in certain prototype luminaires have been the Mean Well LDD-700H-WDA, LDD-1050H-DA, and similar devices with DALI interfaces that are addressable and controllable via +DALI 4008 and −DALI 4009.

Figure 47:
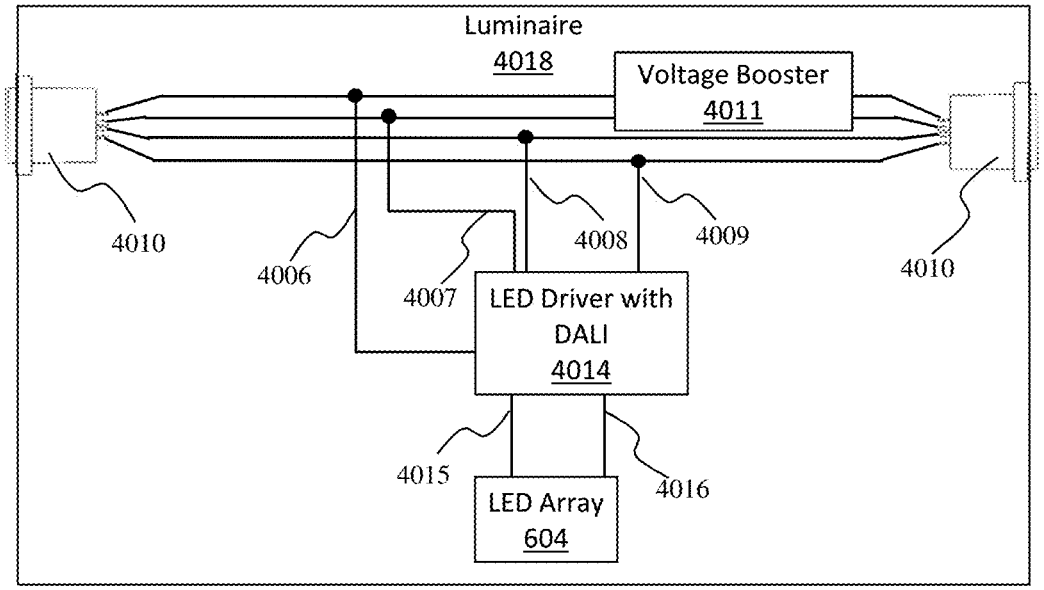
FIG. 47 illustrates a luminaire configured for power and control by an IMS in accordance with aspects of the embodiments.

FIG. 47 illustrates a luminaire 4018 configured for power and control by an IMS in accordance with aspects of the embodiments. Luminaire 4018 is similar to luminaire 4017 excepting that the voltage booster 4011 is configured to boost the voltage of the DC power passed from luminaire 4018 to another luminaire. Circuitry within or ancillary to the voltage booster can select a powered chassis connector 4010 as the power input and the other as the power output.

Figure 48:
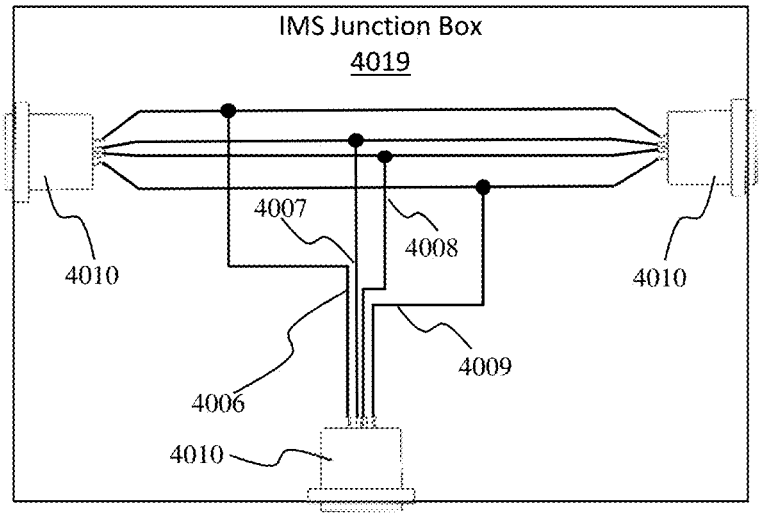
FIG. 48 illustrates an IMS junction box configured for power and control by an IMS in accordance with aspects of the embodiments.

FIG. 48 illustrates an IMS junction box 4019 configured use with an IMS 4003 in accordance with aspects of the embodiments. The junction box has three chassis connectors 4010. The IMS junction box 4019 directly electrically connects V+ on the chassis connectors using V+ wire 4006. The IMS junction box 4019 directly electrically connects V− on the chassis connectors using V− wire 4007. The IMS junction box 4019 directly electrically connects +DALI on the chassis connectors using +DALI wire 4008. The IMS junction box 4019 directly electrically connects −DALI on the chassis connectors using −DALI wire 4009. Other IMS junction boxes can have more than three chassis connectors that are similarly electrically connected.

Figure 49:
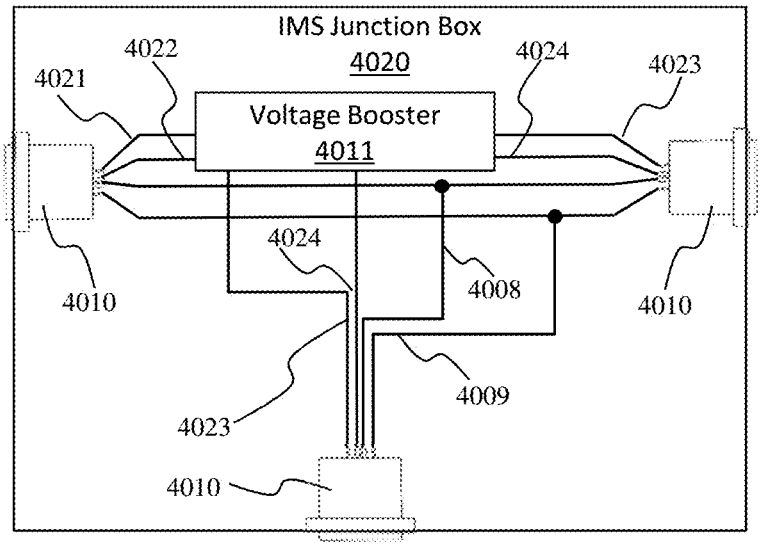
FIG. 49 illustrates an IMS junction box configured for power and control by an IMS in accordance with aspects of the embodiments.

FIG. 49 illustrates an IMS junction box 4020 configured for use with an IMS 4003 in accordance with aspects of the embodiments. The junction box has three chassis connectors 4010. The IMS junction box 4020 directly electrically connects +DALI on the chassis connectors using +DALI wire 4008. The IMS junction box 4020 directly electrically connects −DALI on the chassis connectors using −DALI wire 4009. As with luminaire 4018, IMS junction box 4020 boosts the voltage on the DC power lines. Here, DC power is received on wires 4021, 4022. DC power at a higher voltage is provided by the voltage booster on wires 4023 and 4024. Other IMS junction boxes can have more than three chassis connectors and additional voltage boosters that are similarly electrically connected.

Comparing the junction boxes 4019, 4020 and luminaires 4017, 4018 it can be seen that luminaires incorporate junction box functionality.

Figure 50:
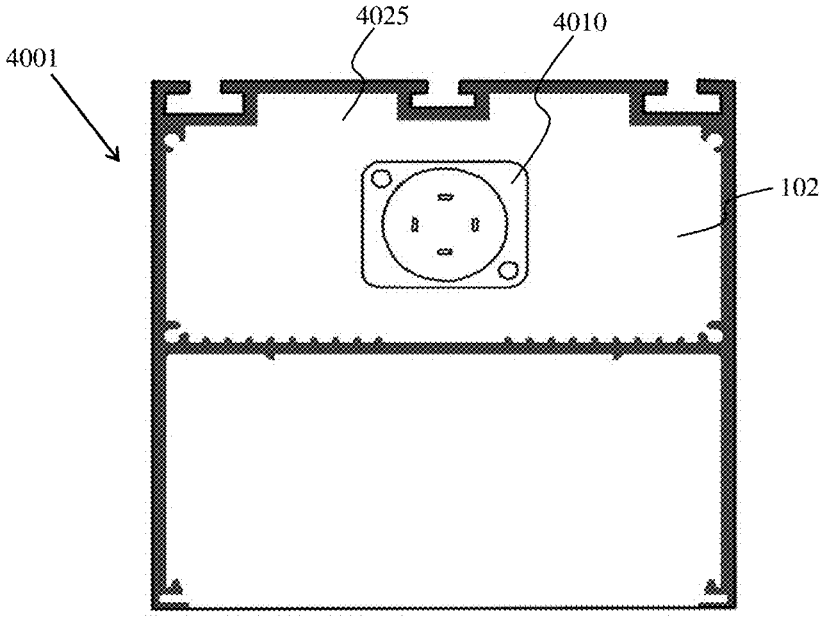
FIG. 50 illustrates a cut view of a luminaire having an IMS chassis connector on the endcap in accordance with aspects of the embodiments.
Figure 51:
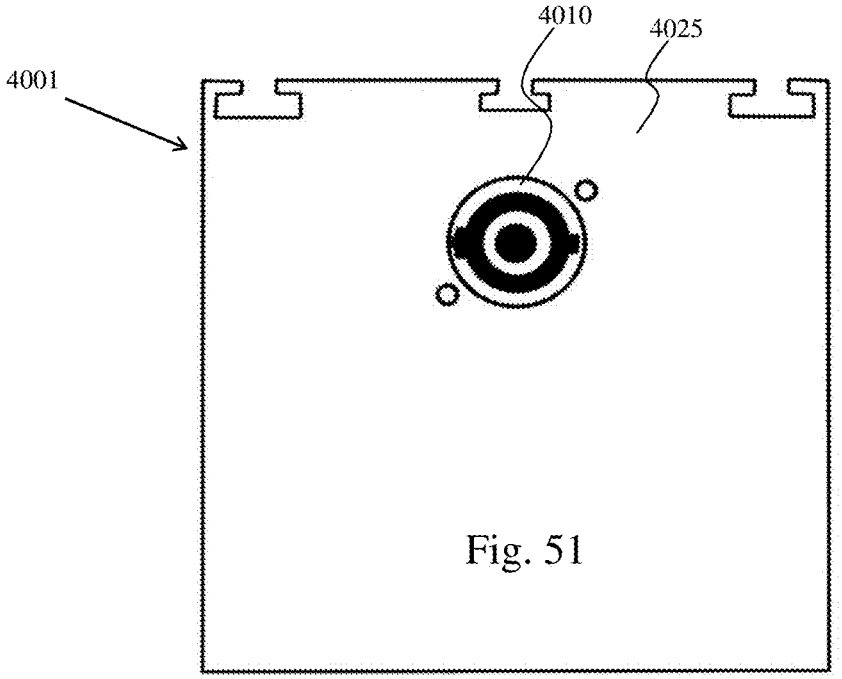
FIG. 51 illustrates a view from the end of a luminaire having an IMS chassis connector on the endcap in accordance with aspects of the embodiments.

FIGS. 50 and 51 illustrate a luminaire 4001 having an IMS chassis connector 4010 on the endcap 4025 in accordance with aspects of the embodiments. FIG. 50 is a cut view viewing the endcap from inside the luminaire. FIG. 51 is an end view of that same luminaire's end cap.

Figure 52:
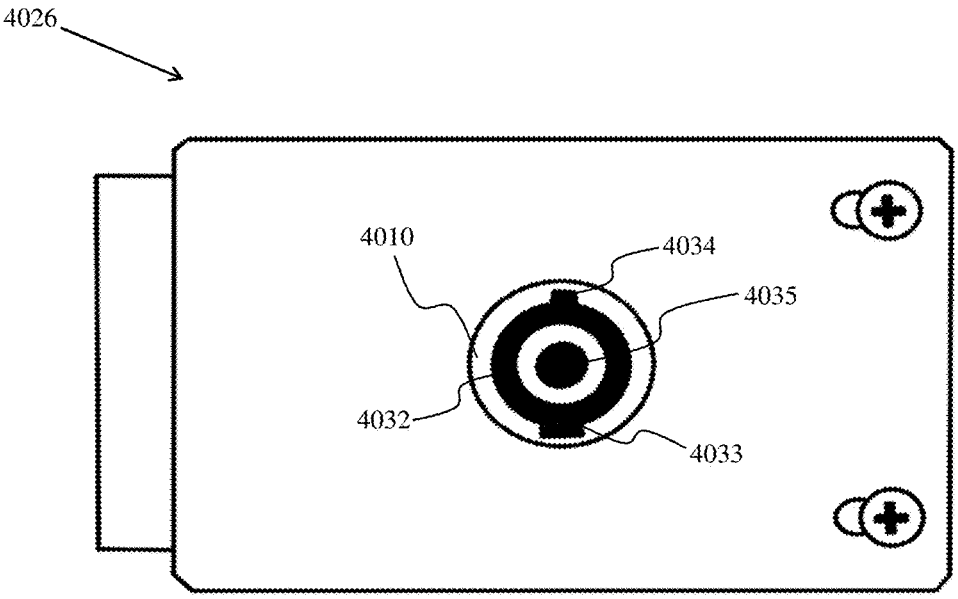
FIG. 52 illustrates a view of a wireway cover having an IMS chassis connector in accordance with aspects of the embodiments.
Figure 53:
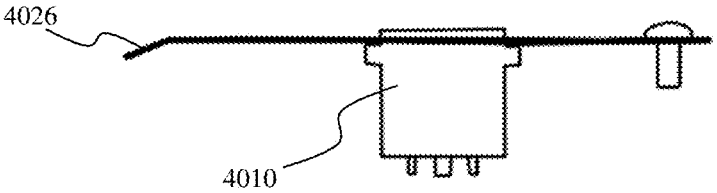
FIG. 53 illustrates a side view of a wireway cover having an IMS chassis connector in accordance with aspects of the embodiments.

FIGS. 52 and 53 illustrate a wireway cover 4026 having an IMS chassis connector 4010 in accordance with aspects of the embodiments. FIG. 52 shows the wireway cover 4026 and the IMS chassis connector 4010 from above. FIG. 53 shows the wireway cover 4026 and IMS chassis connector 4010 from the side.

Figure 54:
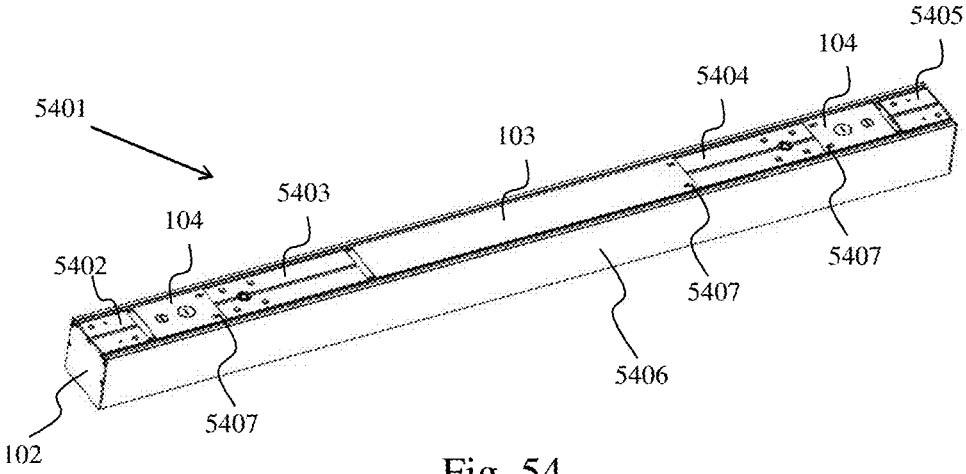
FIG. 54 illustrates a luminaire with an open top extrusion and extruded housing cover segments in accordance with aspects of the embodiments.
Figure 56:
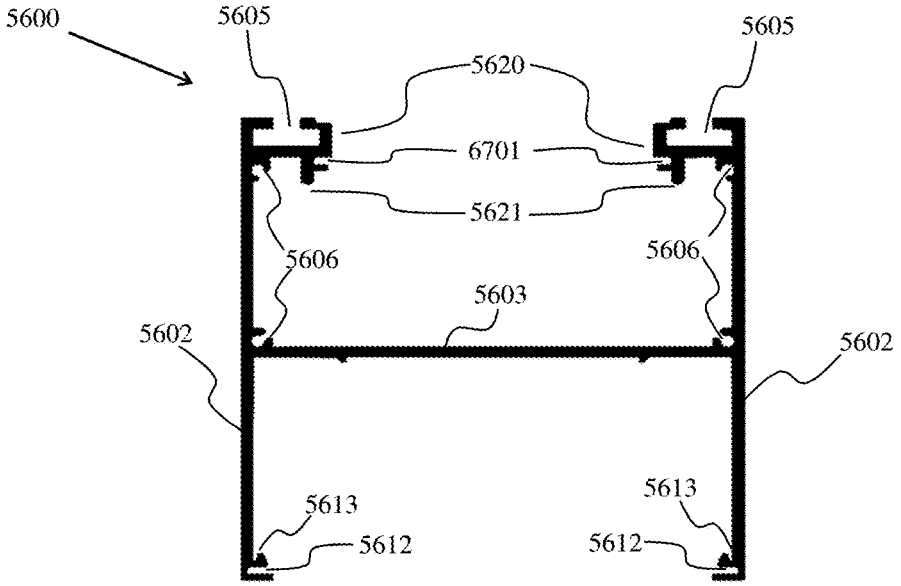
FIG. 56 illustrates the profile of the extrusion of the luminaire of FIG. 54 in accordance with aspects of the embodiments.

FIG. 54 illustrates a luminaire 5401 with an open top extrusion 5406 and extruded housing cover segments 5402, 5403, 5404, 5405 in accordance with aspects of the embodiments. The open top extrusion 5406 can be extruded and has an extrusion profile as shown in FIG. 56. The luminaire's end cap 102, driver cover 103 and wireway covers 104 can be the same as those of the luminaire illustrated in FIG. 1. The driver cover 103 and wireway covers 104 can be fastened to the luminaire by screws 5407 threaded into threaded holes 5408 in the cover segments 5404.

Figure 58:
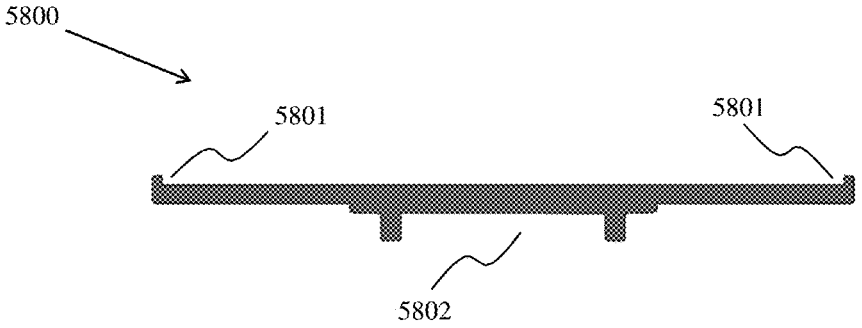
FIG. 58 illustrates a profile of a clamping bracket of the luminaire of FIG. 54 in accordance with aspects of the embodiments.
Figure 59:
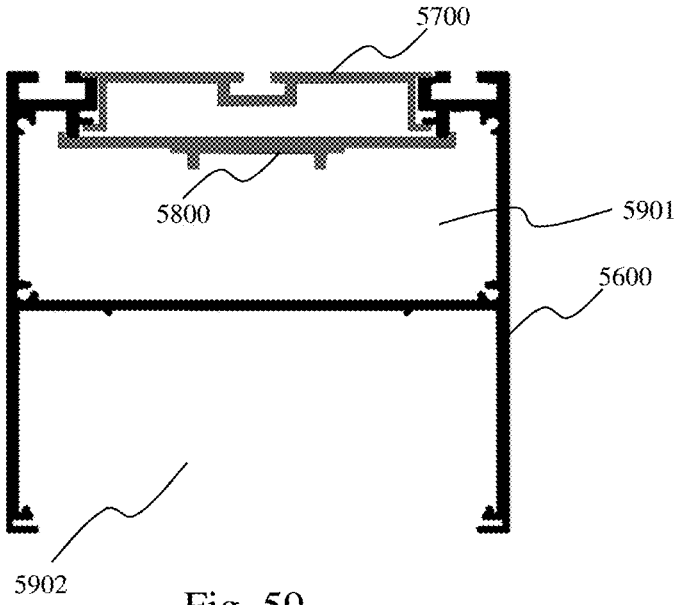
FIG. 59 illustrates an open top extrusion with a cover segment and a clamping bracket in accordance with aspects of the embodiments.

FIGS. 54-66 illustrate aspects of luminaire 5401. Luminaire 5401 is a variation of the luminaire of FIG. 1 that omits the roof of extrusion 300 to yield an open top extrusion that can be produced more efficiently. Extrusions with enclosed cavities, such as the wireway of extrusion 300, can be more expensive and difficult to produce than extrusions such as open top extrusion 5406. An extruded cover having the cover profile seen in FIG. 57 can be slid onto the open top extrusion 5406 as seen in FIG. 59, thereby covering and enclosing the wireway. Clamping brackets 6201, 6401 having clamping bracket profiles as seen in FIG. 58 can fixedly and rigidly attach the extruded cover in place by clamping the extruded cover onto the open top extrusion 5406. The luminaire 5401 of FIG. 54 uses cover segments 5402, 5403, 5404, 5405 instead of a single extruded cover because the luminaire 5401 has wireway covers 104 and a drive cover 103. An embodiment without a driver cover could have a single cover segment reaching from one wireway cover to the other. An embodiment having no driver cover and only one wireway cover could have only two cover segments.

Figure 55:
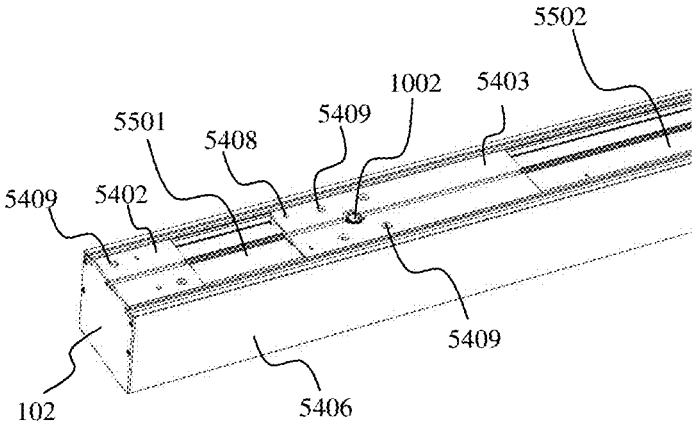
FIG. 55 illustrates an end of the luminaire of FIG. 54 with the wireway covers and driver cover removed in accordance with aspects of the embodiments.

FIG. 55 illustrates an end of the luminaire 5401 of FIG. 54 with the wireway covers 104 and driver cover 103 removed in accordance with aspects of the embodiments. Screws inserted in holes 5409 in the cover segments and threaded into clamping brackets 6201, 6401 can clamp the cover segments in place. Cover end segment 5402 is positioned at the end of the extrusion 5406 by the endcap 102. The end of a threaded nipple 1002 can be seen through a hole in cover middle segment 5403. A wireway cover 104 can be fastened to the cover middle segment by screws driven into threaded holes 5408. The tabs 1205 of the wireway cover 104 and driver cover 103 can slip under a cover segment much as they slipped under the roof of extrusion 300. The gaps between cover end segments 5402, 5405 and cover middle segments 5403, 5404 are wireway openings 5501. The gap between the cover middle segments 5403, 5404 is a power block opening 5502.

FIG. 56 illustrates the profile 5600 of the extrusion 5406 of the luminaire 5401 of FIG. 54 in accordance with aspects of the embodiments. The profile of an extrusion defines the length running elements of the extrusion. As illustrated, the length running elements include two side walls 5602, a cross member 5603, a plurality of screw grooves 5606, two T-channels 5605, two lens slots 5612, and two reflector slots 5613. The side walls 5602 are parallel and the cross member 5603 bridges the side walls 5602 to form a wireway 5901 and a bottom cavity 5902. There are two T-channels 504, one on top of each sidewall 5602. The end caps 102, 202 can be attached to the extrusion 5406 by screws driven into the screw grooves 5606. The extrusion 5406 has cover tracks 5620 and clamp interfaces 5621. A luminaire with uplighting can have an uplight LED array 6702 shining LED light through an uplight lens 6703 installed in uplight channels 6701.

Figure 57:
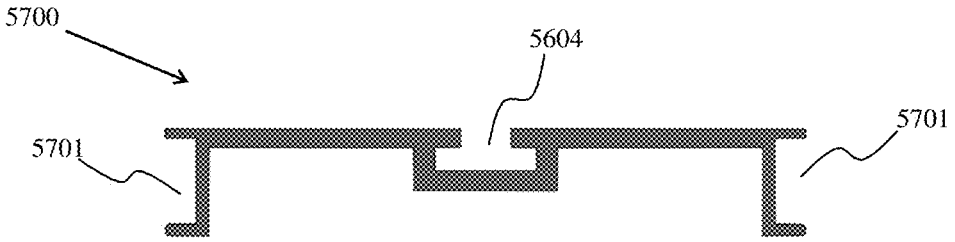
FIG. 57 illustrates a profile of a cover segment of the luminaire of FIG. 54 in accordance with aspects of the embodiments.

FIG. 57 illustrates a profile 5700 of a cover segment 5402, 5403, 5404, 5405 of the luminaire 5401 of FIG. 54 in accordance with aspects of the embodiments. The cover segment has a T-channel 5604 and is symmetric about the center of the T-channel. Housing grooves 5701 are positioned to slidably engage the cover tracks 5620 of the extrusion 5406 such that the cover segment can slide along the extrusion while being held between the cover tracks.

FIG. 58 illustrates a profile 5800 of a clamping bracket 6201, 6401 of the luminaire 5401 of FIG. 54 in accordance with aspects of the embodiments. Each clamping bracket has a threaded nipple engagement 5802 that prevents the threaded nipple 1002 from rotating when installed. Each clamp engages the clamp interfaces of the extrusion 5406 at clamp points 5801.

FIG. 59 illustrates a profile view of an open top extrusion with a cover segment and a clamping bracket in accordance with aspects of the embodiments. The cover segment's housing grooves 5701 can be seen engaging the cover tracks 5620 such that the cover tracks 5620 hold the cover segment within the extrusion 5406 and allow the cover segment to slide along the cover tracks. The clamping bracket can be seen in position with the clamp points engaging the clamp interfaces. Screws passing through holes in the cover segments can be driven into threaded holes in the clamping brackets. Tightening the screws pulls the cover segment and clamping bracket together such that they clamp onto the extrusion.

Figure 60:
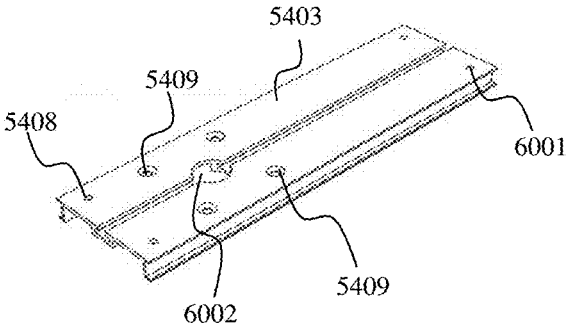
FIG. 60 illustrates a cover middle segment of the luminaire of FIG. 54 in accordance with aspects of the embodiments.

FIG. 60 illustrates a cover middle segment 5403 of the luminaire 5401 of FIG. 54 in accordance with aspects of the embodiments. A wireway cover 104 can be attached to the cover middle segment 5403 by screws threaded into holes 5408 on one end or holes 6001 on the other end. Similarly, a driver cover 103 can be can be attached to the cover middle segment 5403 by screws threaded into holes 5408 on one end or holes 6001 on the other end. Screws passing through holes 5409 can be can be driven into threaded holes 6301 in a pendant clamping bracket 6401 to clamp the cover middle segment to the open top extrusion 5406. A pendant hole 6002 provides access to a threaded nipple 1002 attached to the pendant clamping bracket 6401.

Figure 61:
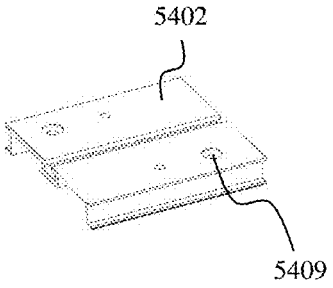
FIG. 61 illustrates a cover end segment of the luminaire of FIG. 54 in accordance with aspects of the embodiments.

FIG. 61 illustrates a cover end segment 5402 of the luminaire 5401 of FIG. 54 in accordance with aspects of the embodiments. Screws passing through holes 5409 can be can be driven into threaded holes 6301 in a clamping bracket 6201 to clamp the cover end segment 5402 to the open top extrusion 5406.

Figure 62:
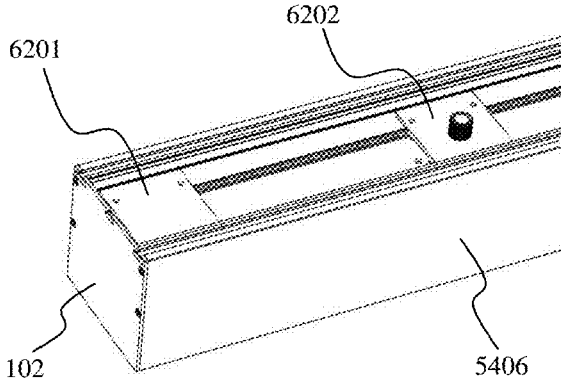
FIG. 62 illustrates a clamping bracket and a pendant clamping bracket in an open top extrusion in accordance with aspects of the embodiments.

FIG. 62 illustrates a clamping bracket 6201 and a pendant clamping bracket assembly 6202 in an open top extrusion 5406 in accordance with aspects of the embodiments. Cover segments 5402, 5403, 5404, 5405 can engage the clamping brackets 6201, 6401 to thereby clamp onto the open top extrusion 5406.

Figure 63:
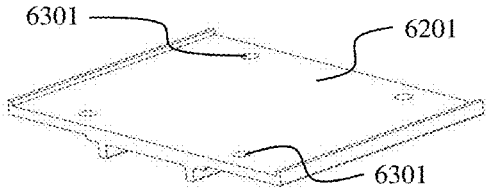
FIG. 63 illustrates a clamping bracket in accordance with aspects of the embodiments.

FIG. 63 illustrates a clamping bracket 6201 in accordance with aspects of the embodiments. Screws passing through holes 5409 can be driven into threaded holes 6301. Holes 5409 can be countersunk, as illustrated, such that the heads of the screw do not extend above the cover segment.

Figure 64:
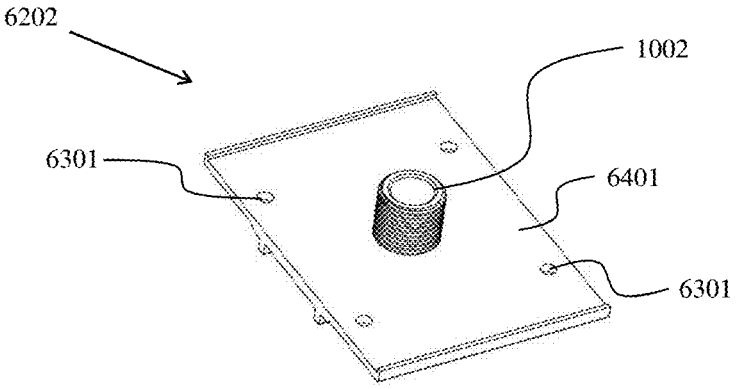
FIG. 64 illustrates pendant clamping bracket assembly viewed from above in accordance with aspects of the embodiments.
Figure 65:
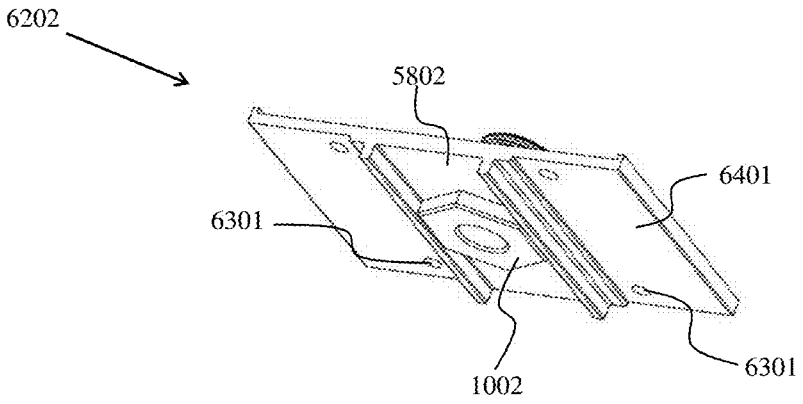
FIG. 65 illustrates pendant clamping bracket assembly viewed from below in accordance with aspects of the embodiments.
Figure 66:
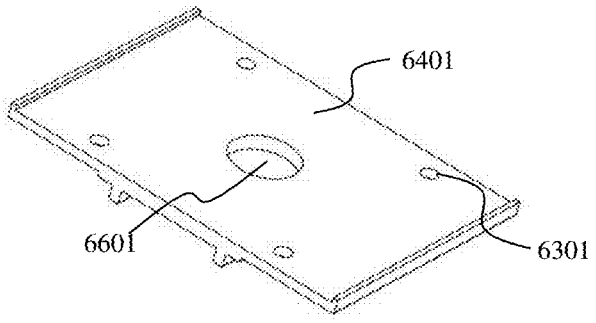
FIG. 66 illustrates pendant clamping bracket viewed from above in accordance with aspects of the embodiments.

FIGS. 64 and 65 illustrate pendant clamping bracket assembly 6202 viewed from above and below, respectively, in accordance with aspects of the embodiments. The pendant bracket assembly has a threaded nipple installed in a pendant clamping bracket 6401. The pendant clamping bracket is illustrated in FIG. 66. The threaded nipple passes through hole 6601 and can be held in place by an e-clip such as e-clip 1003 of FIG. 11. The threaded nipple 1002 has a bolt on one end and threaded nipple engagement 5802 prevent that bolt from rotating, thereby preventing the threaded nipple 1002 from rotating. In this non-limiting example, the clamping bracket 6201 and the pendant clamping bracket 6401 are identical excepting for the hole 6601 in the pendant clamping bracket 6401. As such, all the clamping brackets could be pendant clamping brackets 6401.

Figure 67:
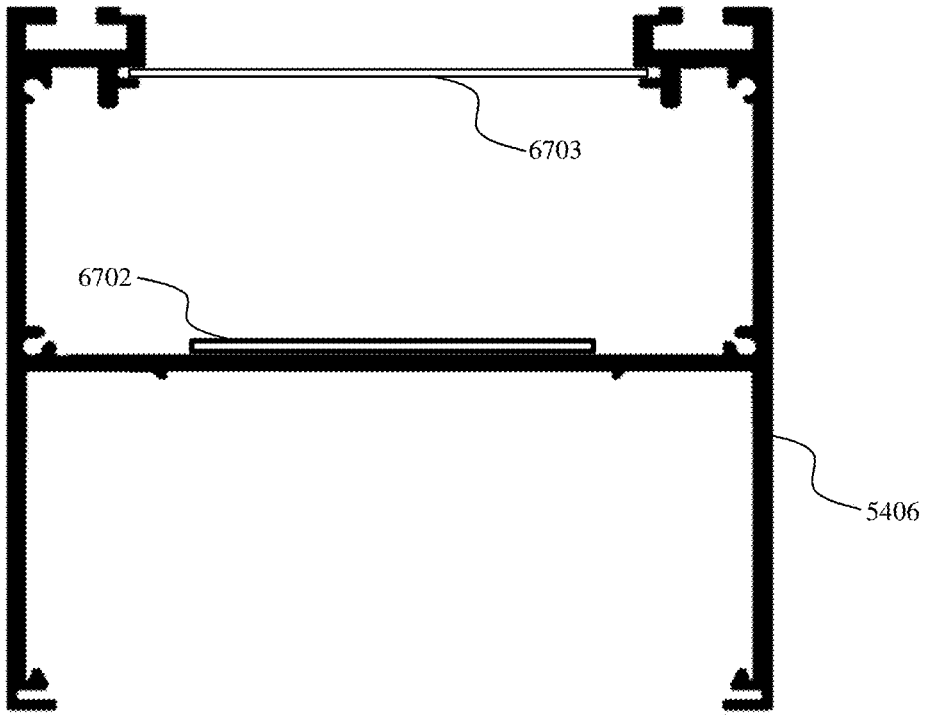
FIG. 67 illustrates a luminaire with an open top extrusion, additional LED array, and top lens in accordance with aspects of the embodiments.

FIG. 67 illustrates a luminaire with an open top extrusion 5406, uplight LED array 6702, and uplight lens 6703 in accordance with aspects of the embodiments. A luminaire with uplighting can have an uplight LED array 6702 shining LED light through the uplight lens 6703 installed in uplight channels 6701 to thereby light a ceiling for aesthetics or to provide indirect lighting.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A lighting system comprising:

a housing wherein the housing comprises an extrusion, two wireway openings, and two end caps, wherein the extrusion comprises a first end, a second end, and a length that runs from the first end to the second end, wherein the two end caps comprise a first end cap and a second end cap, wherein the first end cap is removably attached to the first end, and wherein the second end cap is removably attached to the second end;

a light engine comprising an LED array, and a diffusing lens;

a plurality of length running elements running the length of the extrusion, wherein the plurality of length running elements comprise two side walls, a cross member, a plurality of screw grooves, two T-channels, an LED array facing, and two lens slots, wherein the two side walls are parallel, and wherein the cross member bridges the two side walls to form a wireway and a bottom cavity;

a plurality of wireway covers removably attached to the housing, the plurality of wireway covers covering the two wireway openings;

an IMS chassis connector attached to one of the plurality of wireway covers wherein electric power passes through the IMS chassis connector via two conductors and wherein control signals pass through the IMS chassis connector via a different two conductors;

wherein the two T-channels are positioned at a top of the extrusion and above the wireway;

wherein the LED array comprises a circuit substrate, a plurality of LEDs, and a power input, wherein the plurality of LEDs are arranged in length running rows, wherein the plurality of LEDs are attached to the circuit substrate; and wherein the diffusing lens extends from the first end cap to the second end cap and is positioned within the two lens slots.

2. The lighting system of claim 1 further comprising a ceiling bracket and a housing bracket, wherein the housing bracket is attached to the housing, wherein the ceiling bracket is removably attached to the housing bracket, wherein the ceiling bracket is positioned over one of the two wireway openings, wherein a safety cable is attached to the ceiling bracket and to the housing bracket, and wherein the ceiling bracket is configured for being attached to a junction box and for wires to pass from inside the junction box into the housing.

3. The lighting system of claim 1 wherein the first end cap comprises a plurality of T-cutouts sized and positioned to act as continuations of the two T-channels.

4. The lighting system of claim 3 further comprising a continuous run bracket comprising a plurality of T-rails wherein the plurality of T-rails are sized and configured to slide into the plurality of T-cutouts and into the two T-channels.

5. The lighting system of claim 4 further comprising at least one cover segment comprising two housing grooves, wherein the extrusion further comprises two cover tracks, and wherein the two housing grooves slidably engage the two cover tracks.

6. The lighting system of claim 1 wherein the plurality of length running elements further comprise two LED alignment ribs on either side of the LED array facing, and wherein the two LED alignment ribs are configured for aligning the LED array on the LED array facing.

7. A lighting system comprising:

a housing wherein the housing comprises an extrusion, and two end caps, wherein the extrusion comprises a first end, a second end, and a length running from the first end to the second end, wherein the two end caps comprise a first end cap and a second end cap, wherein the first end cap is removably attached to the first end, and wherein the second end cap is removably attached to the second end;

a light engine comprising an LED array and a diffusing lens;

a plurality of length running elements running the length of the extrusion, wherein the plurality of length running elements comprise two side walls, a cross member, a plurality of screw grooves, two T-channels, an LED array facing, and two lens slots, and wherein the two side walls are parallel, and wherein the cross member bridges the two side walls to form a wireway and a bottom cavity;

at least one cover segment that includes two housing grooves and an additional T-channel, wherein the extrusion includes two cover tracks, and wherein the two housing grooves slidably engage the two cover tracks;

wherein the housing comprises a plurality of T-channels, wherein the plurality of T-channels comprise the two T-channels, wherein each of the two end caps comprises a plurality of T-cutouts sized and positioned to act as continuations of the plurality of T-channels; and wherein the diffusing lens extends from the first end cap to the second end cap and is positioned within both lens slots.

8. The lighting system of claim 7 wherein the plurality of length running elements further comprise two reflector slots, wherein the light engine further comprises a reflector positioned between the cross member and the diffusing lens, wherein the reflector comprises a plurality of openings configured for passing light from the LED array to the diffusing lens, and wherein the reflector is configured to slide into the two reflector slots and form a concave reflecting surface.

9. The lighting system of claim 7 further comprising a threaded nipple installed within the housing and a pendant stem threaded onto the threaded nipple, wherein an electric cable passes through the pendant stem and into the wireway.

10. The lighting system of claim 7 further comprising a wall mount bracket, a T-bolt, and a nut wherein the T-bolt is positioned within one of the plurality of T-channels, wherein the wall mount bracket is attached to the housing by the T-bolt and the nut, and wherein the wall mount bracket is configured for mounting the housing to a wall.

11. The lighting system of claim 7 further comprising a suspension cable and a cable gripper, wherein the cable gripper comprises a T-end that slidably engages one of the plurality of T-channels such that the housing can be suspended from the cable gripper, the cable gripper gripping the suspension cable.

12. The lighting system of claim 7 further comprising a continuous run bracket, a suspension cable and a cable gripper, wherein the continuous run bracket comprises a plurality of T-rails and a bracket channel, wherein the plurality of T-rails slidably engage a plurality of the plurality of T-channels, wherein the cable gripper comprises a T-end sized to slidably engage one of the plurality of T-channels, the cable gripper gripping the suspension cable, and wherein the T-end slidably engages the bracket channel.

13. The lighting system of claim 7 further comprising a second housing and a continuous run bracket, the second housing attached end-to-end to the housing by the continuous run bracket.

14. A lighting system comprising:

an extrusion that includes a first end, a second end, a length between the first end and the second end, a plurality of length running elements running the length of the extrusion and including two side walls, a cross member that bridges the two side walls to form a wireway and a bottom cavity, a plurality of screw grooves, two T-channels, an LED array facing, and two lens slots;

a housing that includes the extrusion, a power block opening, two wireway openings, a first end cap removably attached to the first end, a second end cap removably attached to the second end;

an LED array that includes a circuit substrate, a plurality of LEDs attached to the circuit substrate, and a power input, wherein the plurality of LEDs are arranged in length running rows;

a driver cover covering the power block opening; and a light engine that includes the LED array and includes a power conditioner attached to the driver cover, and a diffusing lens that extends from the first end cap to the second end cap and is positioned within both lens slots, wherein the two T-channels are positioned at a top of the extrusion and above the wireway, the plurality of LEDs are arranged in length running rows, the two side walls are parallel to one another, and the power conditioner is positioned in the wireway.

15. A lighting system comprising:

an extrusion that includes a first end, a second end, a length between the first end and the second end, a plurality of length running elements running the length of the extrusion and including two side walls, a cross member that bridges the two side walls to form a wireway and a bottom cavity, a plurality of screw grooves, two T-channels, an LED array facing, and two lens slots;

a housing that includes the extrusion, a first end cap removably attached to the first end, a second end cap removably attached to the second end;

a light engine that includes an LED array and a diffusing lens;

internal wiring; and a continuous run bracket configured to attach the housing end-to-end to a second housing, wherein the two side walls are parallel to one another, the first end cap and the second end cap both include a plurality of T-cutouts sized and positioned to act as continuations of the two T-channels, and the first end cap includes an inter-housing knockout configured for being knocked out of the first end cap to provide access to the wireway and for the internal wiring to pass through the first end cap and into the second housing.

16. A lighting system comprising:

an extrusion that includes a first end, a second end, a length between the first end and the second end, a plurality of length running elements running the length of the extrusion and including two side walls, a cross member that bridges the two side walls to form a wireway and a bottom cavity, a plurality of screw grooves, two T-channels, an LED array facing, two lens slots, and two reflector slots;

a housing that includes the extrusion, a first end cap removably attached to the first end, a second end cap removably attached to the second end; and a light engine that includes an LED array, a diffusing lens, and a reflector positioned between the cross member and the diffusing lens, wherein the two side walls are parallel to one another, the first end cap and the second end cap both include a plurality of T-cutouts sized and positioned to act as continuations of the two T-channels, the reflector includes a plurality of openings configured for passing light from the LED array to the diffusing lens, and the reflector is configured to slide into the two reflector slots and to form a concave reflecting surface.

17. A lighting system comprising:

an extrusion that includes a first end, a second end, a length between the first end and the second end, a plurality of length running elements running the length of the extrusion and including two side walls, a cross member that bridges the two side walls to form a wireway and a bottom cavity, a plurality of screw grooves, two T-channels, an LED array facing, two lens slots, and two reflector slots;

a housing that includes the extrusion, a first end cap removably attached to the first end, a second end cap removably attached to the second end;

a light engine that includes an LED array, and a diffusing lens;

a threaded nipple installed within the housing;

a pendant stem threaded onto the threaded nipple; and an electric cable that passes through the pendant stem and into the wireway, wherein the two side walls are parallel to one another, and the first end cap and the second end cap both include a plurality of T-cutouts sized and positioned to act as continuations of the two T-channels.

18. A lighting system comprising:

an extrusion that includes a first end, a second end, a length between the first end and the second end, a plurality of length running elements running the length of the extrusion and including two side walls, a cross member that bridges the two side walls to form a wireway and a bottom cavity, a plurality of screw grooves, two T-channels, an LED array facing, two lens slots, and two reflector slots;

a housing that includes the extrusion, a first end cap removably attached to the first end, a second end cap removably attached to the second end;

a light engine that includes an LED array, and a diffusing lens;

a T-bolt positioned within one of the two T-channels; and a wall mount bracket attached to the housing by the T-bolt and a nut, wherein the two side walls are parallel to one another, and the first end cap and the second end cap both include a plurality of T-cutouts sized and positioned to act as continuations of the two T-channels.

19. A lighting system comprising:

an extrusion that includes a first end, a second end, a length between the first end and the second end, a plurality of length running elements running the length of the extrusion and including two side walls, a cross member that bridges the two side walls to form a wireway and a bottom cavity, a plurality of screw grooves, two T-channels, an LED array facing, two lens slots, and two reflector slots;

a housing that includes the extrusion, a first end cap removably attached to the first end, a second end cap removably attached to the second end;

a light engine that includes an LED array, and a diffusing lens; and a cable gripper that includes a T-end that slidably engages one of the two T-channels and configured for gripping a suspension cable and suspending the housing from the cable gripper and the suspension cable, wherein the two side walls are parallel to one another, and the first end cap and the second end cap both include a plurality of T-cutouts sized and positioned to act as continuations of the two T-channels.

* * * * *